US012349787B2

(12) United States Patent
Bienenstock

(10) Patent No.: US 12,349,787 B2
(45) Date of Patent: Jul. 8, 2025

(54) OUTDOOR CLASSROOM SYSTEM AND EARLY LEARNING PODS

(71) Applicant: BIENENSTOCK NATURAL PLAYGROUNDS, INC., Troy (CA)

(72) Inventor: Adam Bienenstock, W. Dundas (CA)

(73) Assignee: BIENENSTOCK NATURAL PLAYGROUNDS, INC., Troy (CA)

( * ) Notice: Subject to any disclaimer, the term of this patent is extended or adjusted under 35 U.S.C. 154(b) by 184 days.

(21) Appl. No.: 18/016,594

(22) PCT Filed: Jul. 15, 2021

(86) PCT No.: PCT/CA2021/050984
§ 371 (c)(1),
(2) Date: Jan. 17, 2023

(87) PCT Pub. No.: WO2022/011478
PCT Pub. Date: Jan. 20, 2022

(65) Prior Publication Data

US 2023/0292917 A1 Sep. 21, 2023

(30) Foreign Application Priority Data

Jul. 15, 2020 (CA) ..... 3086851
Oct. 27, 2020 (CA) ..... 3097171

(51) Int. Cl.
*A47B 39/00* (2006.01)

(52) U.S. Cl.
CPC ..... *A47B 39/00* (2013.01); *A47B 2230/0077* (2013.01)

(58) Field of Classification Search
CPC ..... A47B 83/008; A47B 83/02; A47B 87/00; A47B 87/002; A47B 39/00; A47B 2330/0077
(Continued)

(56) References Cited

U.S. PATENT DOCUMENTS 2,995,408 A * 8/1961 Kobrin ..... A47B 69/00 312/239
3,002,787 A * 10/1961 Ziegenfuss ..... A47C 13/005 D6/381

(Continued)

FOREIGN PATENT DOCUMENTS

CN 2263476 Y 10/1997
CN 107035173 A 8/2017
WO WO-2015092157 A1 * 6/2015 ..... A47B 21/02

OTHER PUBLICATIONS https://www.theprogress.com/community/outdoor-classroom-brings-bc-kids-closer-to-nature-with-play-and-learning/ (The Chilliwack Progress) May 3, 2019.

(Continued)

*Primary Examiner* — Jose V Chen
(74) *Attorney, Agent, or Firm* — BOND, SCHOENECK & KING, PLLC; George R. McGuire

(57) ABSTRACT

A portable outdoor classroom system for teachers and students is disclosed. The system includes a plurality of workstations adapted to accommodate the students and teacher in a seating or standing position each workstation including a seating portion and a work desk portion. A blackboard may be included along with one or more shade sail mounted on posts or logs to protect the outdoor classroom system against sun and inclement weather. Also disclose are pre-school early learning pods designed to support early learners with a wider range of developmental needs and abilities. The early learning pods include vertical cluster logs arranged in clusters and combined with whacky support logs, horizontal border logs and other items such as carved log tunnels and carve chair logs to form enclosed or open learning areas.

9 Claims, 20 Drawing Sheets

(58) Field of Classification Search
USPC ..... 297/135, 243, 245, 248, 249, 257; 108/64
See application file for complete search history.

(56) References Cited

U.S. PATENT DOCUMENTS

| | | | | | |
|---|---|---|---|---|---|
| 3,053,598 | A * | 9/1962 | Cheslow | A47B 87/002 | D6/687 |
| 3,267,881 | A * | 8/1966 | Saggione | A47B 13/10 | 108/59 |
| 3,366,415 | A * | 1/1968 | Cooper | A47B 13/10 | 297/158.3 |
| 4,091,746 | A | 5/1978 | Kimbrough | | |
| 5,115,609 | A * | 5/1992 | Sing | E04C 3/14 | 144/368 |
| 5,423,597 | A * | 6/1995 | Rogers | A47D 11/00 | 5/2.1 |
| 5,485,794 | A * | 1/1996 | Sing | B65D 19/0073 | 108/57.21 |
| 5,655,822 | A * | 8/1997 | Roberts | A47B 87/002 | 108/50.01 |
| 5,775,046 | A * | 7/1998 | Fanger | A47B 87/007 | 108/158.12 |
| 5,842,425 | A * | 12/1998 | van der Aa | A47B 87/002 | 108/103 |
| 5,974,985 | A * | 11/1999 | Flototto | A47B 13/02 | 108/50.01 |
| 6,161,487 | A * | 12/2000 | Chang | A47B 21/00 | 108/50.01 |
| 6,170,410 | B1 * | 1/2001 | Gioacchini | A47B 87/002 | 108/50.01 |
| 6,182,580 | B1 * | 2/2001 | Barrett | F16B 12/125 | 403/381 |
| 6,644,748 | B2 * | 11/2003 | Tholkes | A47B 9/00 | 297/423.12 |
| 9,622,570 | B1 * | 4/2017 | Holdredge | A47B 5/00 | |
| 10,626,602 | B2 * | 4/2020 | Holbrook | E04B 2/78 | |
| D883,687 | S * | 5/2020 | Urquiola | D6/336 | |
| 2002/0178670 | A1 * | 12/2002 | D'Urbino | E04H 1/1272 | 52/655.1 |
| 2003/0183134 | A1 * | 10/2003 | Jackson | A47F 9/00 | 108/64 |
| 2005/0126446 | A1 * | 6/2005 | Nobles | A47C 7/72 | 108/27 |
| 2005/0166805 | A1 * | 8/2005 | Loines | A47B 96/1416 | 248/188 |
| 2006/0238003 | A1 * | 10/2006 | Larsen | A47B 3/14 | 297/135 |
| 2006/0254479 | A1 * | 11/2006 | Luchetti | A47C 9/022 | 108/64 |
| 2006/0283098 | A1 * | 12/2006 | Golino | A47B 87/00 | 52/36.1 |
| 2008/0035031 | A1 * | 2/2008 | Yamanishi | A47B 87/002 | 108/50.02 |
| 2010/0126394 | A1 * | 5/2010 | Burak | A47B 83/001 | 108/186 |
| 2011/0204756 | A1 * | 8/2011 | DeMars | A47F 9/00 | 312/258 |
| 2011/0232534 | A1 * | 9/2011 | Ochs | A47B 87/002 | 108/1 |
| 2011/0309659 | A1 * | 12/2011 | Beauchamp | A47C 1/12 | 108/22 |
| 2012/0112500 | A1 * | 5/2012 | Rundle | B64D 11/0601 | 297/135 |
| 2018/0020828 | A1 * | 1/2018 | Nourse | A47B 83/045 | 312/223.6 |
| 2020/0069052 | A1 * | 3/2020 | Allen | A47B 83/001 | |
| 2020/0345137 | A1 * | 11/2020 | Spyridopoulos | A47F 10/06 | |
| 2022/0047070 | A1 * | 2/2022 | Fauley | A47B 83/024 | |
| 2022/0087418 | A1 * | 3/2022 | Baloga | A47B 87/002 | |
| 2023/0329434 | A1 * | 10/2023 | Lucci | A47B 83/001 | |

OTHER PUBLICATIONS https://chestervillerecord.com/2019/06/26/sainte-therese-davila-unveils-outdoor-classroom/(The Chesterville Record) Jun. 26, 2019.

https://www.facebook.com/HabitateSystems/photo/a.199566402500/10157653710482501/?type=3&theater(Habitat Systems Inc. Facebook page ) Jun. 8, 2018.

https://www.wrdsb.ca/wp-content/uploads/wrdsbguidelines.k_12-Outdoor-play.pdf (Waterloo Region District School Board) Aug. 2016.

International Search Report, Application No. PCT/CA2021/050984, dated Oct. 15, 2021, pp. 3-6.

* cited by examiner

OUTDOOR CLASSROOM SYSTEM AND EARLY LEARNING PODS

CROSS-REFERENCE TO RELATED APPLICATION(S)

This is a national stage application filed under 37 U.S.C. 371 based on International Patent Application No. PCT/CA2021/050984, filed Jul. 15, 2021, which claims priority to Canadian Patent Application No. 3,086,861 filed Jul. 15, 2020, and Canadian Patent Application No. CA 3,097,171 filed Oct. 27, 2020, the disclosure of each of which is incorporated herein by reference in its entirety.

FIELD

The present disclosure relates to an outdoor classroom system, and in particular to an outdoor classroom system and early learning pods for pre-school children that can be quickly set up and taken down and is easy to package, transport and store. It also relates to an outdoor classroom system that can be easily converted to a climbing play structure or tiered seating structure when not in use. The pre-school early learning pods can be configured to address a wide range of developmental needs and abilities of early learners.

BACKGROUND

Outdoor learning, while in many ways similar to indoor learning, presents unique challenges and opportunities that differ from indoor learning with regard to the following problems:

Durability—challenges generally relate to materials and designs that must withstand heavy use, vandalism, and failure due to inappropriate use. Outdoor classrooms must additionally withstand exposure to elements that cause natural decay, and lack of supervision to prevent behaviours that could cause systems to fail. Attempts to overcome these challenges generally relate to the use of artificial materials such as plastic, steel and rubber to achieve durability. Innovative uses of natural materials to achieve durability outdoors include concrete forms, carved stone or wood surfaces that have been coated to resist wear from use and natural decay. Depending on the material and method, coating natural surfaces may pose increased health and safety risks for users. Outdoor systems must also be designed to endure unstructured and unsupervised use that can cause systems to fail.

Sustainability—challenges generally relate to materials that may be unsustainably sourced or manufactured and that may require significant resources to transport, assemble, remove or repurpose. Outdoor classroom designs must also consider the "heat island effect" of artificial materials such as plastic, steel and rubber, which tend to absorb and re-emit the sun's heat more than natural materials, thus contributing to global warming. Attempts to overcome these challenges generally relate to the use of sustainably sourced materials and designs that reduce carbon footprint in manufacture, transportation and maintenance. Outdoor systems can draw upon local, indigenous materials that are renewable, sustainably sourced, readily available and naturally suited to their environment, thus requiring minimal maintenance. Outdoor systems may also be constructed of natural materials that reduce heat island effects which contribute to global warming. Durability also impacts sustainability.

Accessibility—challenges generally relate to furniture and systems that are unable to support teaching and learning for all ages and abilities. Attempts to overcome these challenges generally relate to adjustable seating and workspaces to accommodate a wider range of ages and abilities. Outdoor classrooms may be wheelchair accessible, but seating may not be suitable for all ages and abilities and workspaces may be lacking altogether. Health and safety may also impact accessibility.

Cost—challenges generally relate to the cost of design, manufacture, transport, assembly, removal, and repurposing of furniture and classroom systems. Attempts to overcome these challenges generally relate to indoor furniture and systems designed to be lightweight, easily transported, easily assembled and maintained. Outdoor classrooms may utilize low-cost local natural materials that can be constructed onsite. Natural materials may be heavier and harder to transport than artificial materials but may be more durable and less costly to maintain outdoors. Durability also impacts cost.

Ergonomics—challenges generally relate to poorly designed furniture and systems that can negatively impact posture and circulation, thus reducing comfort, attention and focus for teaching and learning. Attempts to overcome these challenges for indoor learning generally relate to adjustable furniture and systems designed to improve comfort, circulation, focus and attention for a wide range of ages and abilities. Outdoor classroom systems designed for simplicity and durability may not be suitable for all ages and abilities.

Safety—challenges generally relate to requirements to meet safety standards for defined uses and individuals of varying ages and abilities. Outdoor learning must also accommodate open ended and unsupervised use where the user decides how to optimize for their own learning. Outdoor classrooms must also contend with thermal performance concerns where elevated surface temperatures can pose safety risks. Attempts to overcome these challenges generally relate to materials and designs that meet or exceed safety standards and which can safely accommodate a wider range of ages and abilities. The use of natural materials can improve thermal performance to reduce the risk of burns and heat stroke.

Health—challenges generally relate to artificial materials or natural surfaces that have been coated with artificial materials which contain chemical toxins that can emit into the local environment. Artificial surfaces such as plastic, steel and rubber exhibit higher viral loads and pose higher risks of viral transmission than porous natural surfaces, thus requiring frequent disinfecting between uses. On the other hand, natural surfaces tend to self-disinfect through naturally occurring microbial and enzymatic activity and open cellular structures that are maintained. Attempts to overcome these challenges generally relate to material selection to mitigate or eliminate volatile organic compounds and chemical toxins that could pollute the local environment. Natural materials can also be used to reduce viral loads and transmission risks. Ergonomics also impacts health Configurability—challenges generally relate to the ability to reconfigure furniture and classroom systems for alternative uses. Indoor systems tend to be made for defined uses and may not be reconfigurable. Outdoor systems may be too large to be movable or too small and lightweight, requiring permanent anchoring, thus limiting reconfigurability. Attempts to overcome these challenges in indoor classroom furniture or systems generally relate to the ability to change or add features without changing primary use. In outdoor systems the attempts tend to relate to designs that allow for open ended and unsupervised use without the need to change or add features.

In general, current outdoor classroom systems are difficult to transport, set up and take down and have limited alternative uses. Current systems are made from plastic or steel, which maintain viral loads for up to four or five days.

Accordingly, there is a need to develop outdoor classrooms systems to expand classroom space in schools and other teaching institutions while at the same time addressing and overcoming the above challenges while maintaining physical distancing to stop or reduce the spread of viruses.

SUMMARY

The present disclosure teaches an outdoor classroom system and early learning pods that offers a natural, flexible, pedagogically sound approach to quickly scaling up classroom capacity and pre-school learning outside to take pressure off teachers and school inside. The components of the system are made from porous, natural wood materials that do not need to be disinfected and on which virus are not supported for more than a few hours.

The disclosure further teaches an outdoor classroom system and pre-school early learning pods that can be reconfigured from a finite set of manufactured parts to meet the constraints of unique customer requirements, a wide range of children's developmental abilities, and highly variable outdoor space restrictions, without requiring customization. The outdoor classroom system and pre-school early learning pods system may be quickly installed, easily reconfigured, surface mounted without the need for anchoring while still offering compliance with Government safety standards such as ASTM, ANSI, CSA, and ADA. The outdoor classroom system and pre-school early learning pods system are compliant with local state, provincial and federal regulations for children's outdoor environments across the US and Canada and has been designed to optimize packaging and transportation. Both systems are constructed of natural materials selected to suit specific outdoor environments and withstand the elements to mitigate natural decay and are designed to optimize pedagogical outcomes and withstand heavy, outdoor, open-ended and unsupervised use that could cause other systems to fail. The outdoor classroom system can be easily converted to a climbing play structure or tiered seating structure when retired from use as an outdoor classroom. The pre-school early learning pods system can be configured to address a wide range of developmental needs and abilities of early learners. The pre-school early learning pods system can be installed in confined spaces and surface mounted on virtually any surface without breaking the ground plain, including concrete pads and rooftops, to provide a turnkey, safe and accessible natural early learning environment for pre-school aged children with wide ranging developmental needs and abilities.

In accordance with one aspect then, there is provided a portable outdoor classroom system comprising: a plurality of workstations to accommodate at least one student and at least one teacher in a seating or standing position each workstation comprising a seating portion and desk portion; wherein the seating portion is removably connectable to the desk portion by a tongue and groove connection.

The outdoor classroom system may include at least one blackboard and further may include at least one shade sail mounted on support logs to protect the outdoor classroom system against sun and inclement weather. The outdoor classroom system may further include at least one curriculum cabinet for storage. The seating portion and the desk portion may be constructed from wood and the wood may be wooden logs. The portable outdoor classroom system may be configured for conversion into at least one of a climbing structure or a tiered seating structure.

In accordance with another aspect, there is provided an early learning pod system comprising: a plurality of vertical cluster logs; and a plurality of horizontal border logs; wherein at least one of the vertical cluster logs is removably connectable to at least one of the border logs by a tongue and groove connection.

The vertical cluster logs and the border logs of early learning pod system may form an enclosed space when connected. The early learning pod system may include a carved tunnel log, or at least one whacky support log removably connectable to at least one of the vertical cluster logs by a tongue and groove connection.

BRIEF DESCRIPTION OF THE DRAWINGS

Further features of the outdoor classroom system and early learning pods disclosed herein will become apparent from the following written description and the accompanying figures, in which.

DETAILED DESCRIPTION

Figure 1:
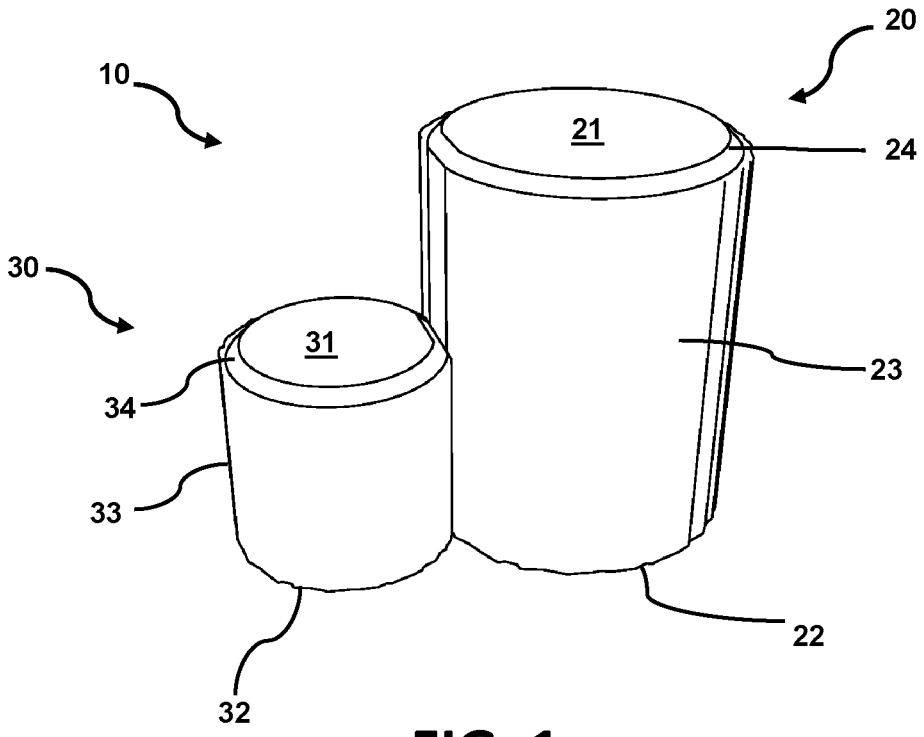
FIG. 1 shows one embodiment of a workstation of the outdoor classroom system disclosed herein.

The outdoor classroom system and pre-school early learning pods disclosed herein addresses the above-mentioned challenges in one or more of the following ways:

Durability—natural materials are selected to suit specific outdoor environments and withstand the elements to mitigate natural decay. Components are designed to withstand heavy, outdoor, open-ended and unsupervised use that could cause other systems to fail.

Sustainability—natural materials are sustainably sourced. Components and systems are designed for carbon efficient production shipping, assembly and maintenance. Avoidance of artificial materials such as plastic, steel and rubber and non-biodegradable waste streams. Natural surfaces reduce or eliminate heat island effects.

Accessibility—student and teacher seat-desks are designed to accommodate a wide range of ages and abilities for use as either seated or standing workstations. Systems ship with equipment to set components into alternate patterns to accommodate any teaching style and flexible individual or group learning.

Cost—to reduce production costs each student and teacher seat-table is dovetailed and secured with just one fastener. To reduce transportation costs student and teacher seat-desks are designed to stack for palletized shipping, allowing multiple prefabricated classrooms to be shipped on a single flatbed trailer. To reduce assembly and installation costs the system is designed as a low-impact, safety-compliant surface mount system that allows each classroom system to be set up or removed in about an hour. A standard soccer pitch can be converted into an outdoor school with 12 to 18 classrooms in one day. The pre-school early learning pods are designed using interlocking components so that any specific configuration is self-contained, self-stabilizing, safety compliant, and surface mountable without breaking the ground plane or requiring additional anchoring on virtually any surface including unlevel ground as well as concrete pads and rooftops, thus allowing for efficient assembly and installation. To reduce removal costs low-impact surface mount system allows each outdoor classroom system to be removed within an hour; an entire field of outdoor classrooms can be removed within a few hours. Instead of paying to dispose of used classrooms, outdoor classroom system and early learning pods disclosed herein can be reconfigured into standard compliant play structures or social gathering structures.

Ergonomics—student and teacher seat-desks are designed for specific height differentials between the seat and tabletop to accommodate sitting or standing work for a wide range of ages and abilities. The outdoor classroom system disclosed herein may include natural buffers and shelter to enhance the learning environment. The systems are designed with natural materials in dimensions appropriate for various ages and abilities for open-ended use, compared to indoor classroom systems. The applicant's outdoor classrooms improve cognitive development (focus and attention), social and emotional development (self-regulation), language development (receptive and expressive), motor development (motor planning) and sensory development (tactile, visual, olfactory). Through configurations designed to achieve full sensory engagement for certain developmental outcomes, applicant's early learning pods systems improve gross motor, fine motor, vestibular, balance, smell, touch, sight, sound and proprioception.

Safety—student and teacher seat-desks are designed to specific height, diameter, and weight ratios to eliminate the risk of incidental tipping. Blackboards are designed for ground clearance in open fields and stability to reduce the risk of incidental or wind related tipping. Classrooms and converted social or play structures may be easily designed to comply with mandated Government safety standards such as ASTM, ANSI, CSA, ADA. Natural surfaces improve thermal performance and reduce risks of burns and heat stroke. The pre-school early learning pods are designed using interlocking components so that any specific configuration is self-contained, self-stabilizing, safety compliant, and surface mountable without breaking the ground plane or requiring additional anchoring on virtually any surface including unlevel ground as well as concrete pads and rooftops to comply with mandated safety standards.

Health—natural surfaces self-disinfect overnight compared with 4 to 5 days for plastic, steel and rubber. Flexibility in spacing allows for a range of distancing protocols. Each student seat-table provides a backpack hitch to keep materials self-contained. Natural materials can provide healthy microbial interactions that are proven to boost immune systems.

Configurability—applicant's outdoor classrooms may be transformed into play structures that are compliant with various Government safety standards such as ASTM, ANSI, CSA, ADA. Applicant's outdoor classrooms may also be reconfigured for social gatherings, student study groups, and bleachers for sports fields.

The outdoor classroom systems shown in FIGS. 1 to 14 and disclosed herein are designed to be portable and configurable to accommodate a plurality of teaching styles and class sizes, as well as individual and group learning for students of all ages and abilities.

The pre-school early learning pods system shown in FIGS. 15 to 24 and disclosed herein are designed to support early learners—infants to pre-school aged children—with a wider range of developmental needs and abilities than more mature school-aged children and are designed to be configurable in a plurality of arrangements to optimize for intense, immersive sensory engagement to achieve certain core developmental outcomes for early childhood education. The various configurations shown and disclosed are designed to enable sensory rich play-based educational experiences for early learners.

FIG. 1 shows a workstation 10 including a desk 20 connected to a seat 30. Both the desk 20 and seat 30 are segments of a cylinder. The cylindrical design allows for the use of raw, large caliper logs from a variety of tree species that can be selected to suit the local environment that require minimal debarking to maintain the natural state and defenses of the wood. The desk 20 has a flat round top surface 21, a flat round bottom surface 22 and side walls 23 connecting the top 21 and bottom 22. The seat 30 has a flat round top surface 31, a flat round bottom surface 32 and sidewalls 33 connecting the top 31 and bottom 32. The top edge 24 of the desk 20 and the top edge 34 of the seat 30 may be beveled around the entire top circumference, respectively. The seat 30 and the desk 20 are sized and configured to provide a comfortable seating position for a student or a teacher, including a sufficient workspace on desk 20 for teachers and students of varying ages and abilities.

Figure 2:
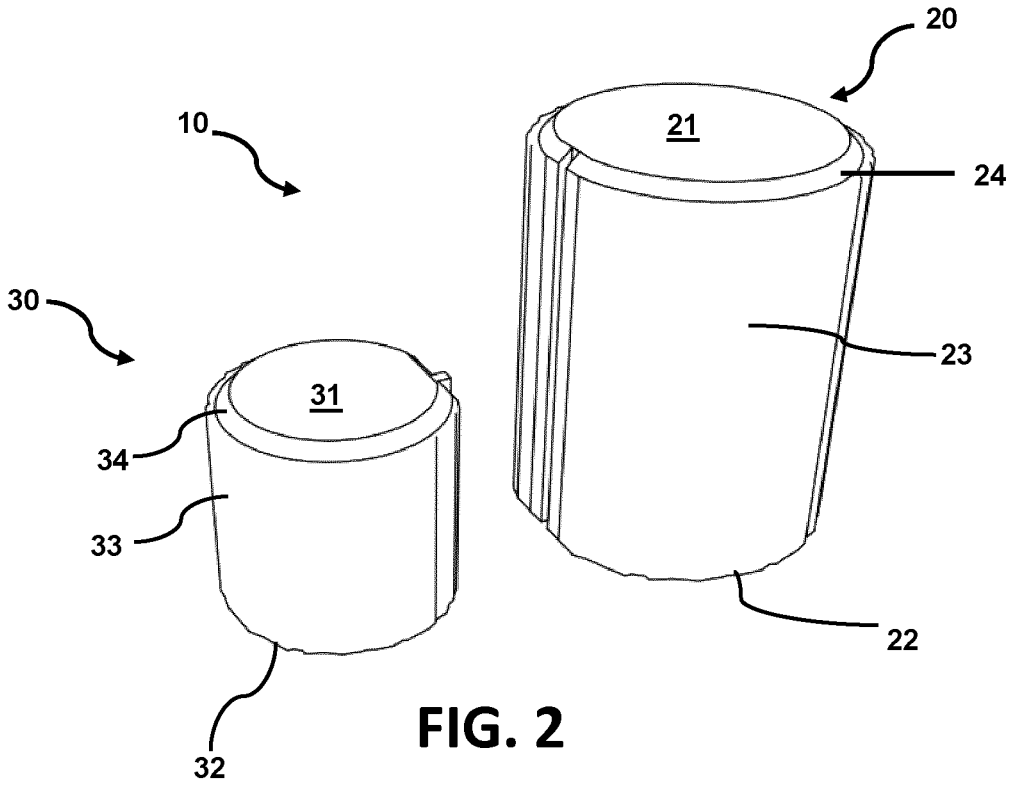
FIG. 2 is an exploded view of the components shown in FIG. 1.

FIG. 2 shows the desk 20 and the seat 30 of the workstation 10 in a disconnected configuration to illustrate how the two components connect and interlock. The desk 20 includes a flat segment 25 cut vertically the entire length of the side wall 23 from the top 21 to the bottom 23. A groove 26 is cut into the center of the flat segment 25, the groove 26 also extending from the top 21 to the bottom 22 of the desk 20.

The seat 30 also includes a flat segment 35 cut vertically the entire length of the side wall 33 from the top 31 to the bottom 33. A tongue 36 is formed in the center of the flat segment 35, the tongue 36 also extending from the top 31 to the bottom 32 of the seat 30.

As shown in FIG. 1, the desk 20 removably connects to the seat 30 by engaging the tongue 36 with the groove 26 such that the two flat segments 25 and 35 come into contact. The tongue 36 and the groove 26 may be dovetailed so that they may only be fit together by sliding the seat 30 vertically from the top of the desk 30 downward or from the bottom of the desk 20 upward. Once fit together in this manner the seat 30 is locked onto the desk 20 and can only be separated by sliding one or the other fully up or down to disengage the tongue 36 from the grove 26. Workstations 10 may be arranged in various configurations for individual or group learning.

One skilled in the art will appreciate that the above-described tongue and groove system may be configured in the alternative with the groove formed into the seat 30 and the tongue formed into the desk 20.

Figure 3:
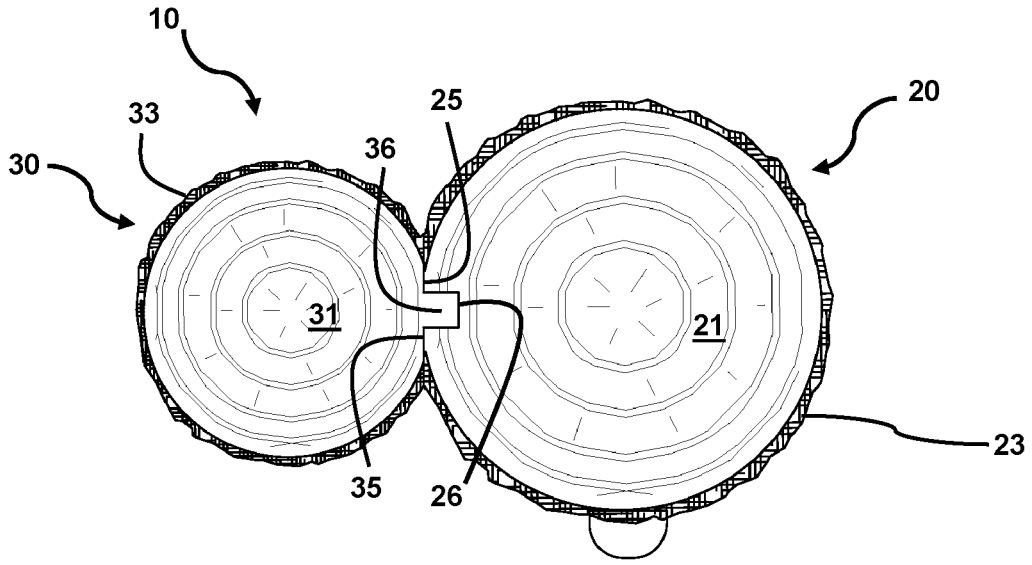
FIG. 3 is a top plan view of the workstation of FIG. 1.
Figure 4:
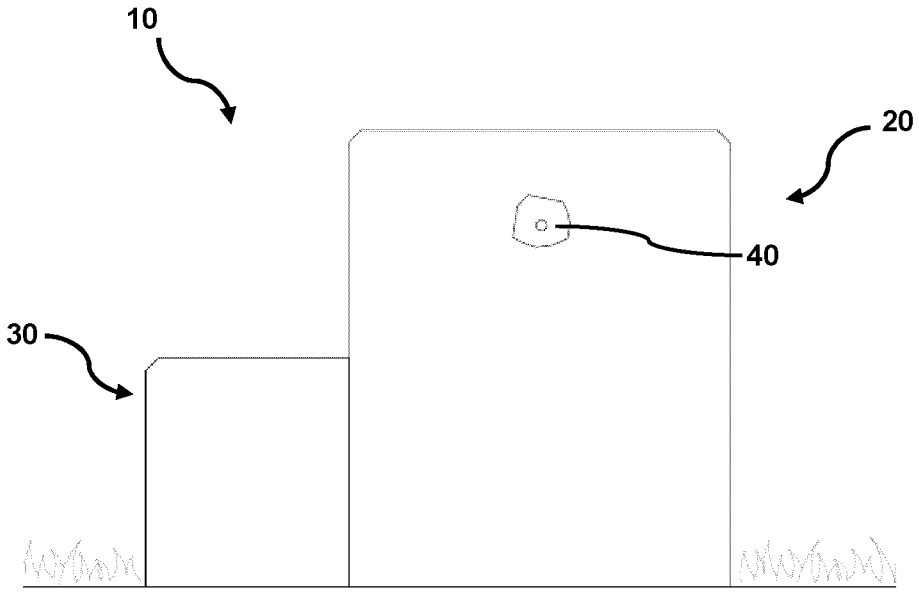
FIG. 4 is s side elevation view of the workstation shown in FIG. 1.

FIG. 3 shows a top view of the workstation 10 and FIG. 4 shows a side elevation view. The desk 20 may be fitted with a bag holder 40 on one side to provide a place for the student or teacher to hang their belongings to keep them off the ground.

To accommodate both students and teachers of different sizes, desk 20 may range in size from between 24 and 36 inches in height and have a diameter of between 18 and 30 inches. Seat 30 may range in size from between 12 and 18 inches in height and have a diameter of between 10 and 17 inches.

Figure 5:
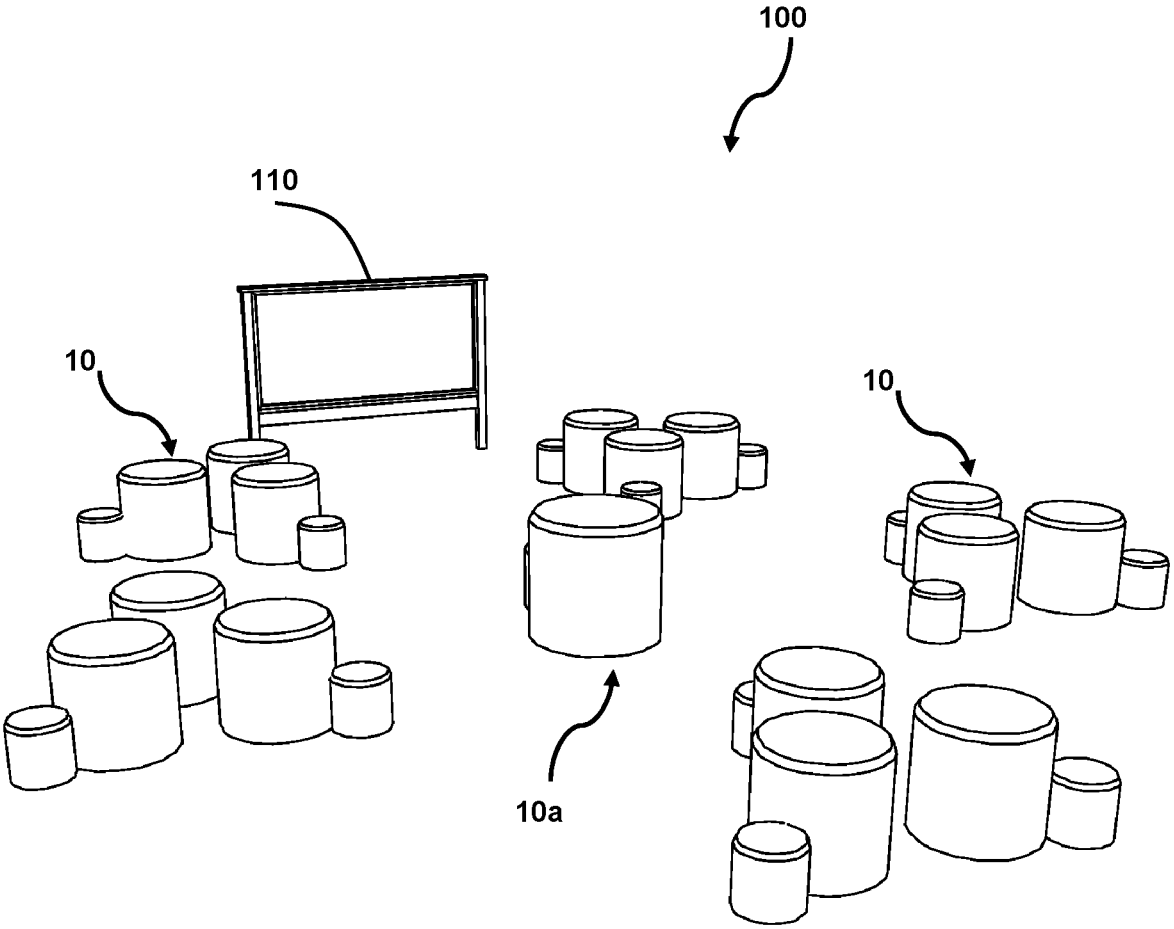
FIG. 5 is a perspective view of one possible arrangement of the outdoor classroom system disclosed herein including a blackboard.
Figure 6:
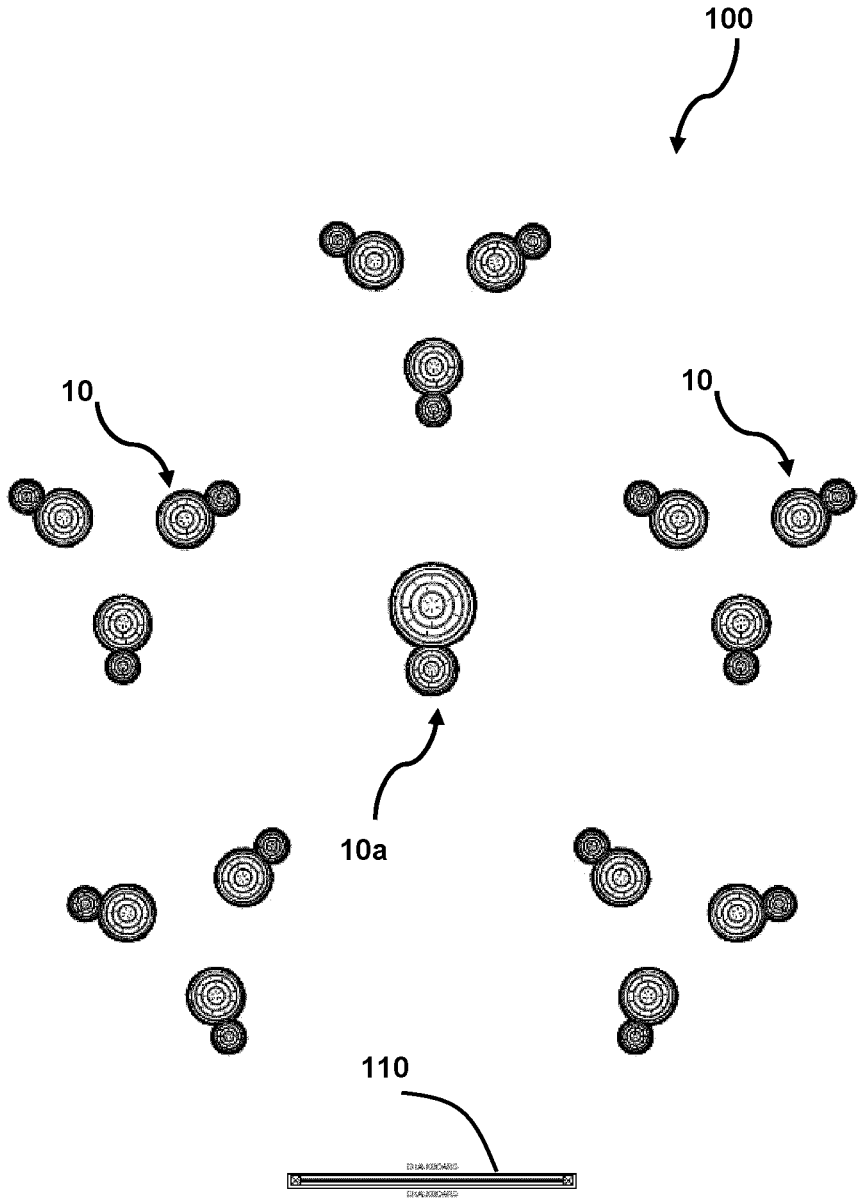
FIG. 6 is a top plan view of the arrangement shown in FIG. 5.

FIGS. 5 and 6 show one embodiment of an outdoor classroom 100 that includes multiple workstations 10, at least one of which may be sized and configured large enough to accommodate an adult teacher (shown located in the center of the classroom 100 at reference 10*a*). Included as well may be a blackboard 110 or some other device on which the teacher is able to write or provide visual content to the students. Blackboard 110 has a stabilizing base and a rugged frame with sufficient ground clearance to work in open fields, and a writing surface made from natural materials and coatings to withstand inclement weather conditions.

Figure 7:
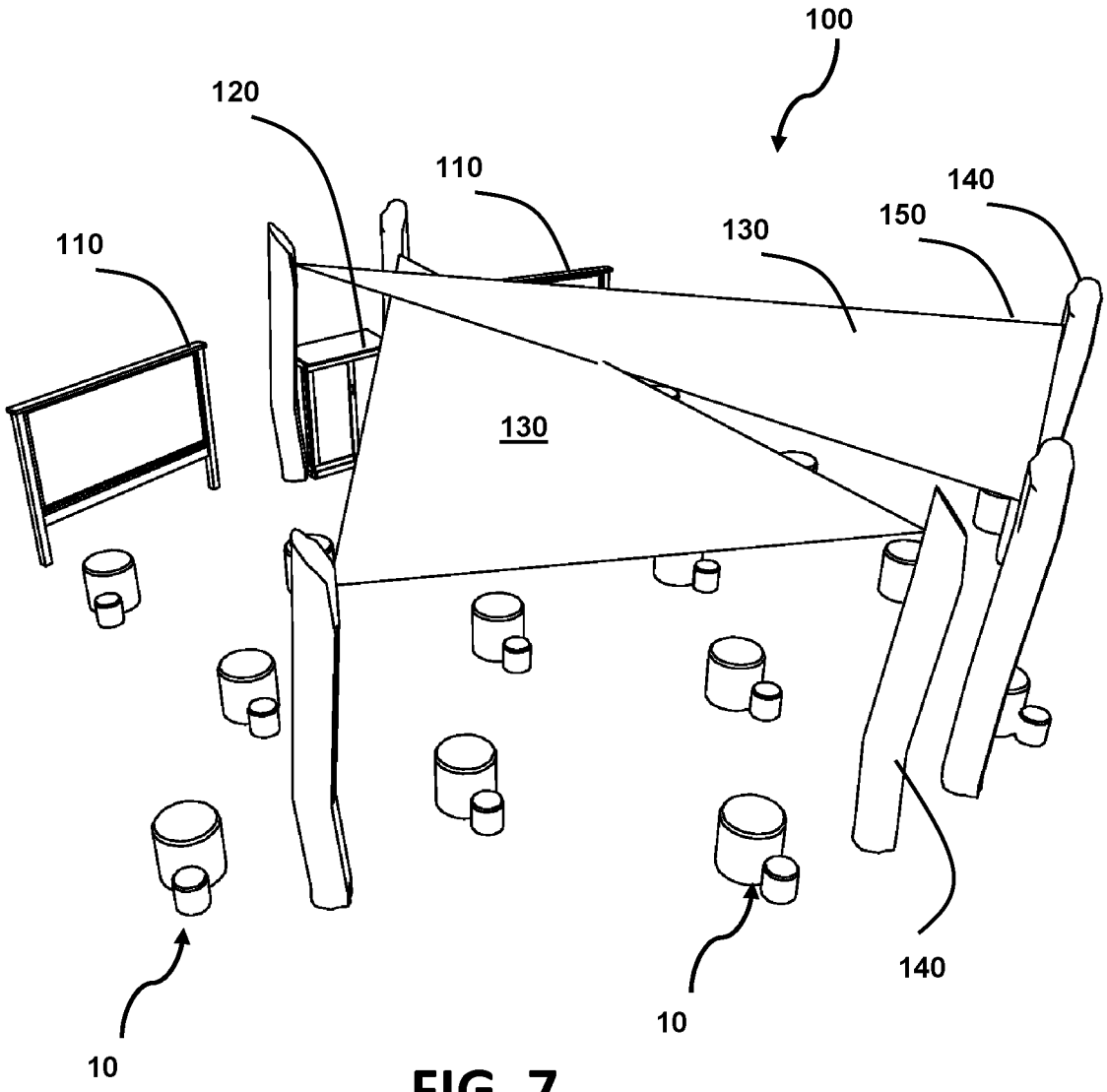
FIG. 7 is a perspective view of another possible arrangement of the outdoor classroom system disclosed herein, including blackboards, whacky support post, shade sails and a curriculum cabinet.
Figure 8:
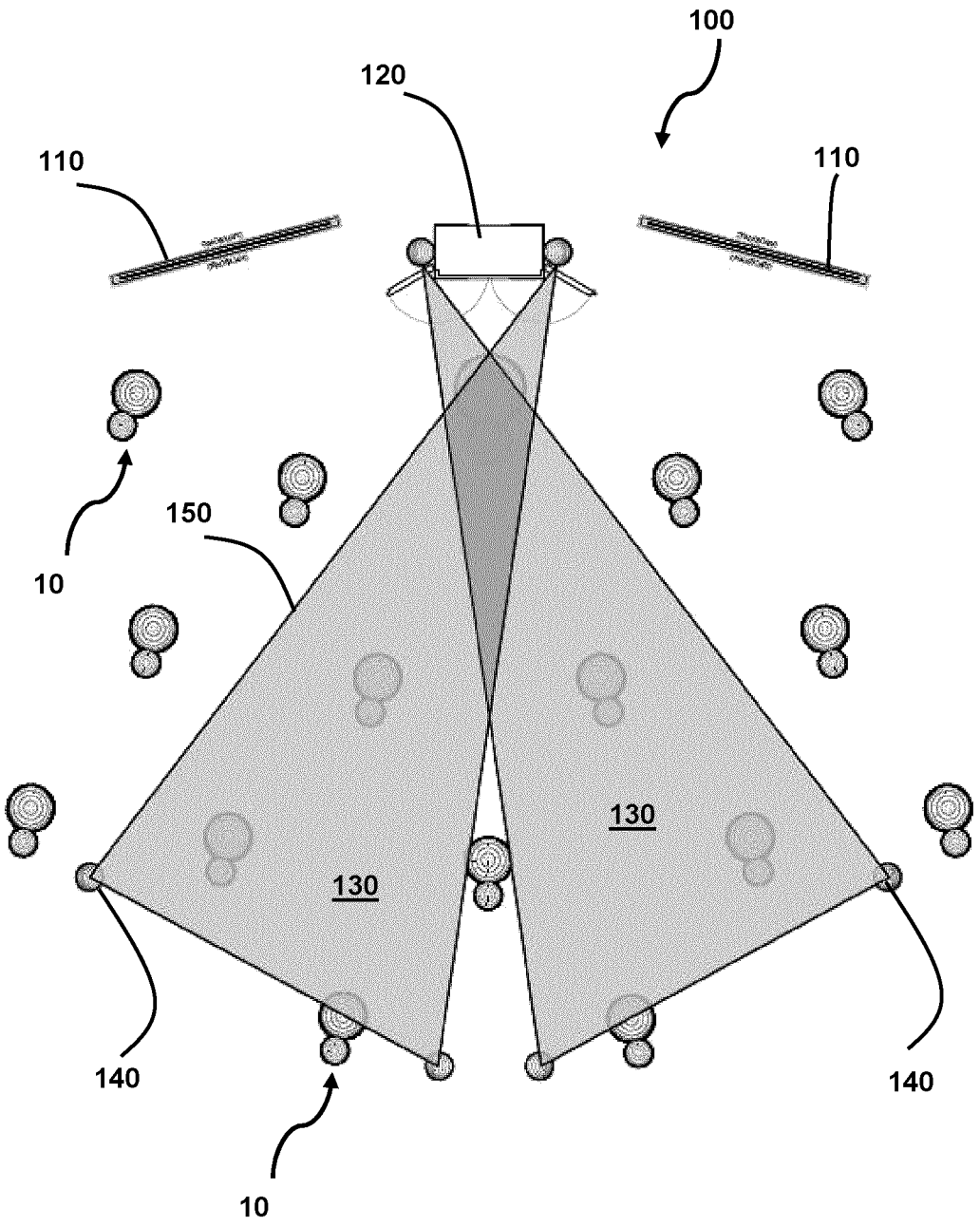
FIG. 8 is a top plan view of the arrangement shown in FIG. 7.

FIGS. 7 and 8 show another embodiment of an outdoor classroom 100 that may include one or more curriculum cabinets 120 for storage of teaching supplies and other items. Curriculum cabinets 120 may be constructed with a stabilizing base and a rugged frame and with front door panels as a blackboard writing surface. The Cabinets 120 are made from natural materials and coatings to withstand inclement weather conditions. Shade sails 130 may be installed on whacky support logs 140 to protect the outdoor classroom 100 against sun and inclement weather. Shade sails 130 are shown supported on wires 150 connected between whacky support logs 140. Shade sails 130 are constructed of natural materials and coatings to provide shade and shelter from inclement weather. Whacky support logs 140 are constructed of raw large caliper logs with minimal debarking to maintain the natural state and defenses of the wood. In addition, fence panels and planters (not shown) may be used to separate and provide privacy between adjacent outdoor classroom systems. Fence panels and planters are constructed of chemical free, durable wood species.

Figure 9:
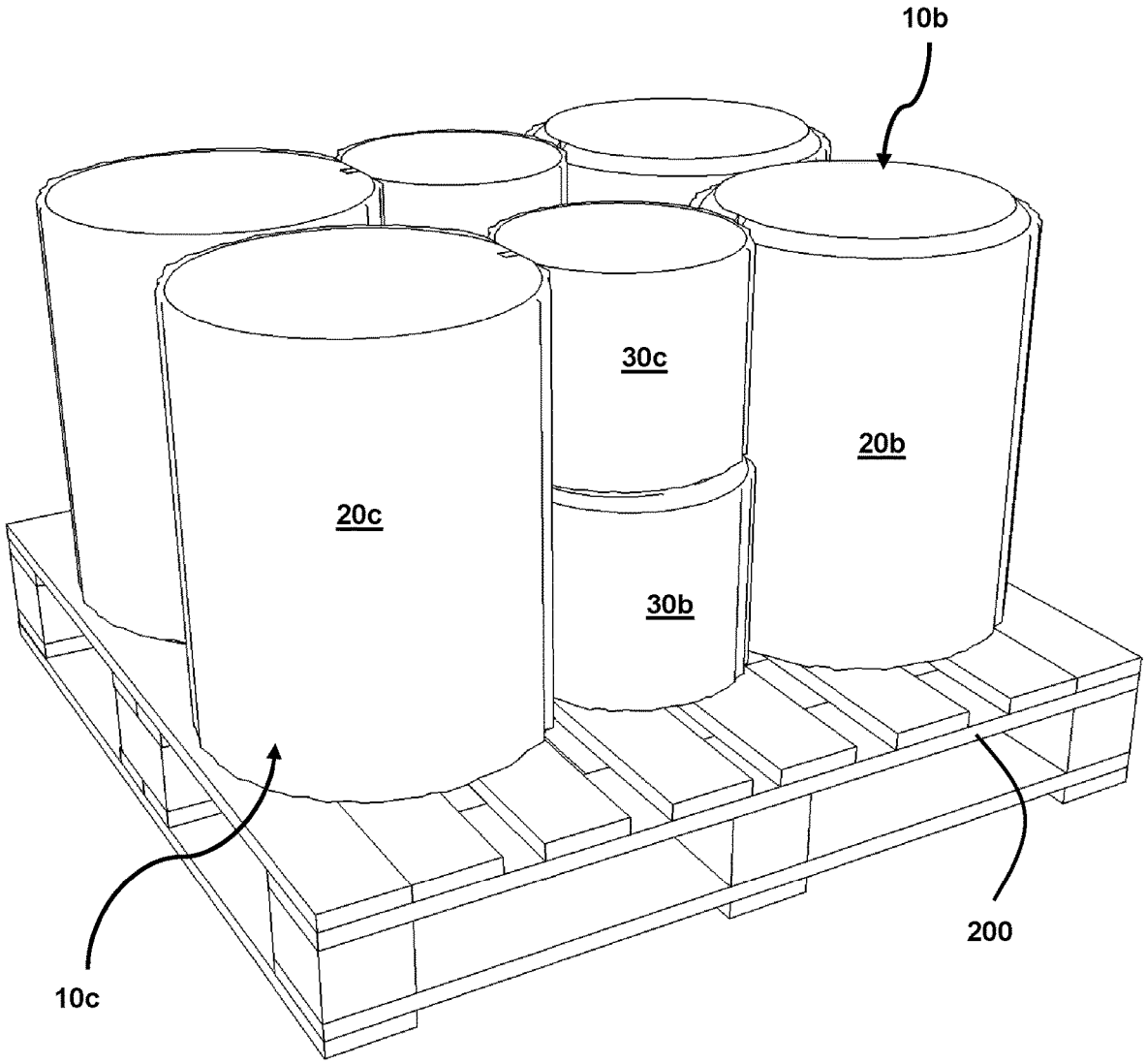
FIG. 9 show the workstations of the outdoor classroom system arranged on a pallet for shipping or storage.
Figure 10:
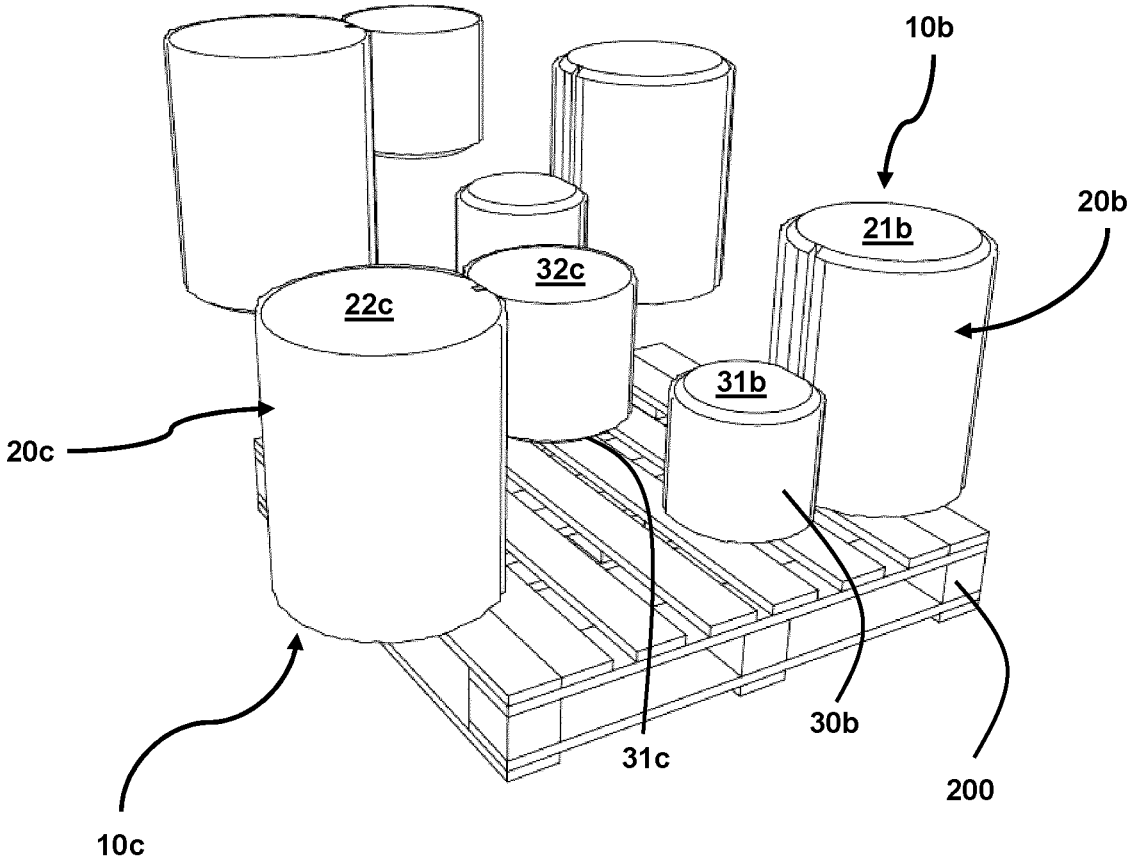
FIG. 10 is an exploded view of the components shown in FIG. 9.
Figure 11:
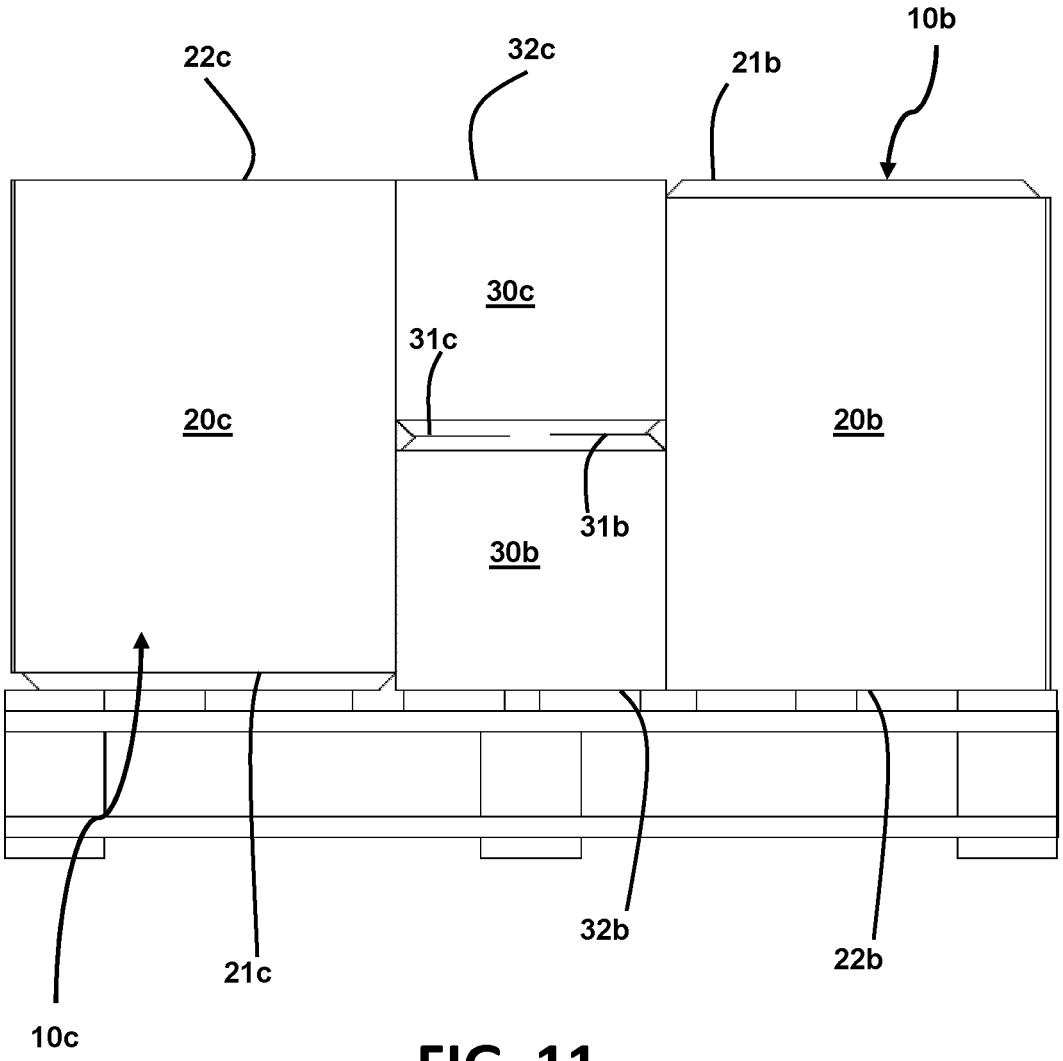
FIG. 11 is a side elevation view of the components shown in FIG. 9.

FIGS. 9 to 11 illustrate how the workstations 10 may be advantageously packed together and palletized for shipping or storage. For example, seat 30*b* and desk 20*b* of workstation 10*b* are connected using the tongue and groove system described above and arranged to fit together in a compact arrangement with seat 30*c* and desk 20*c* of workstation 10*c* that are similarly connected. Workstation 10*c* is inverted and arranged so that the top 31*c* of seat 30*c* rests on the top 31*b* of seat 30*b*. Workstation 10*b* is arranged so that the bottom 32*b* of seat 30*b* is on the same plane as the top 21*c* of desk 20*c*. When workstation 10*c* is inverted and placed next to workstation 10*b* on a shipping pallet 200 or in a fixed storage location, the top 31*c* of seat 30*c* is able to rest on the top surface 31*b* of the seat 30*b* of the adjacent workstation 10*b*. By arranging multiple workstations 10 together in this manner the workstations take up less space, are more stable, and may be stacked both vertically and horizontally.

Figure 12:
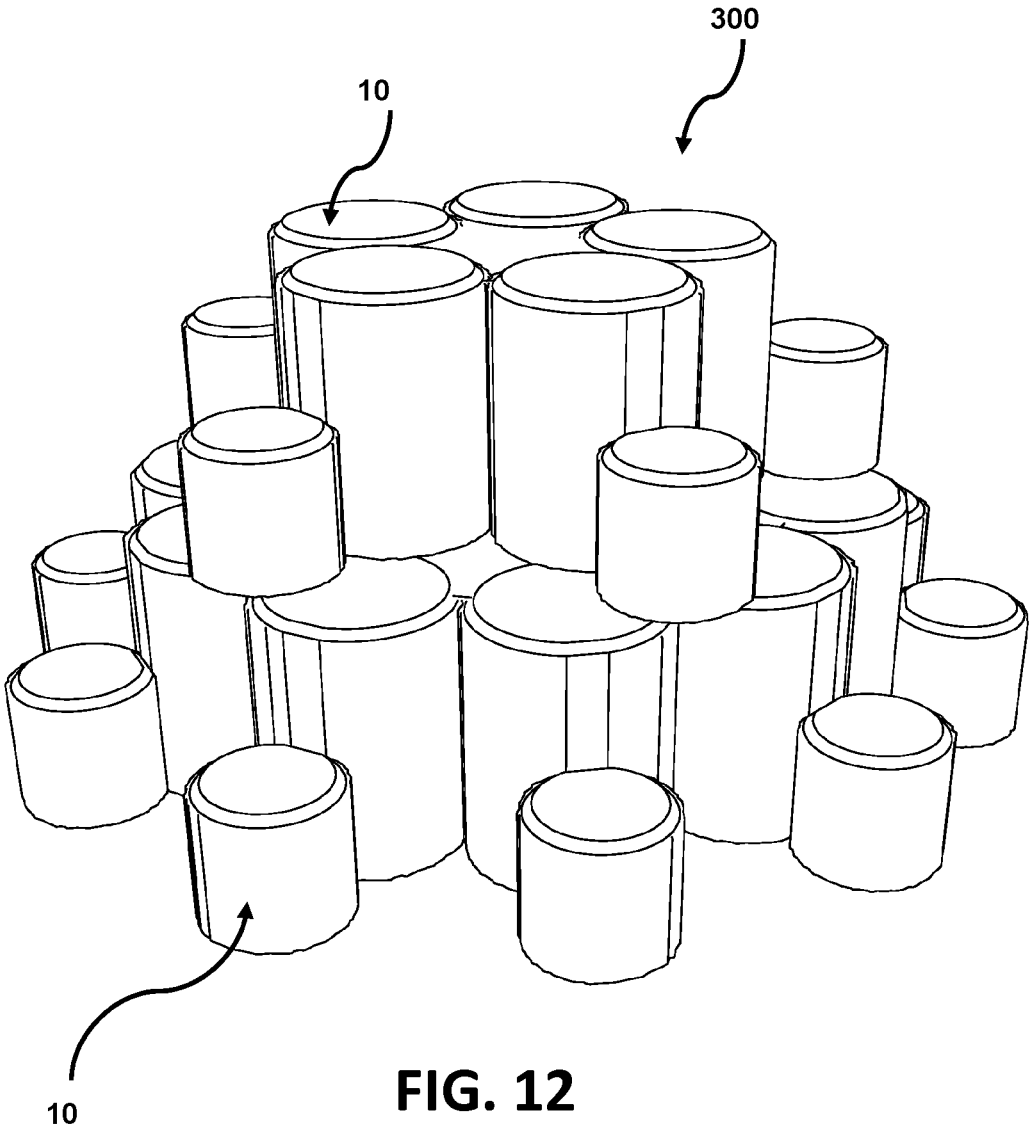
FIG. 12 is a perspective view of the workstations of the outdoor classroom system arranged to create a combing play structure or tiered seating structure.
Figure 13:
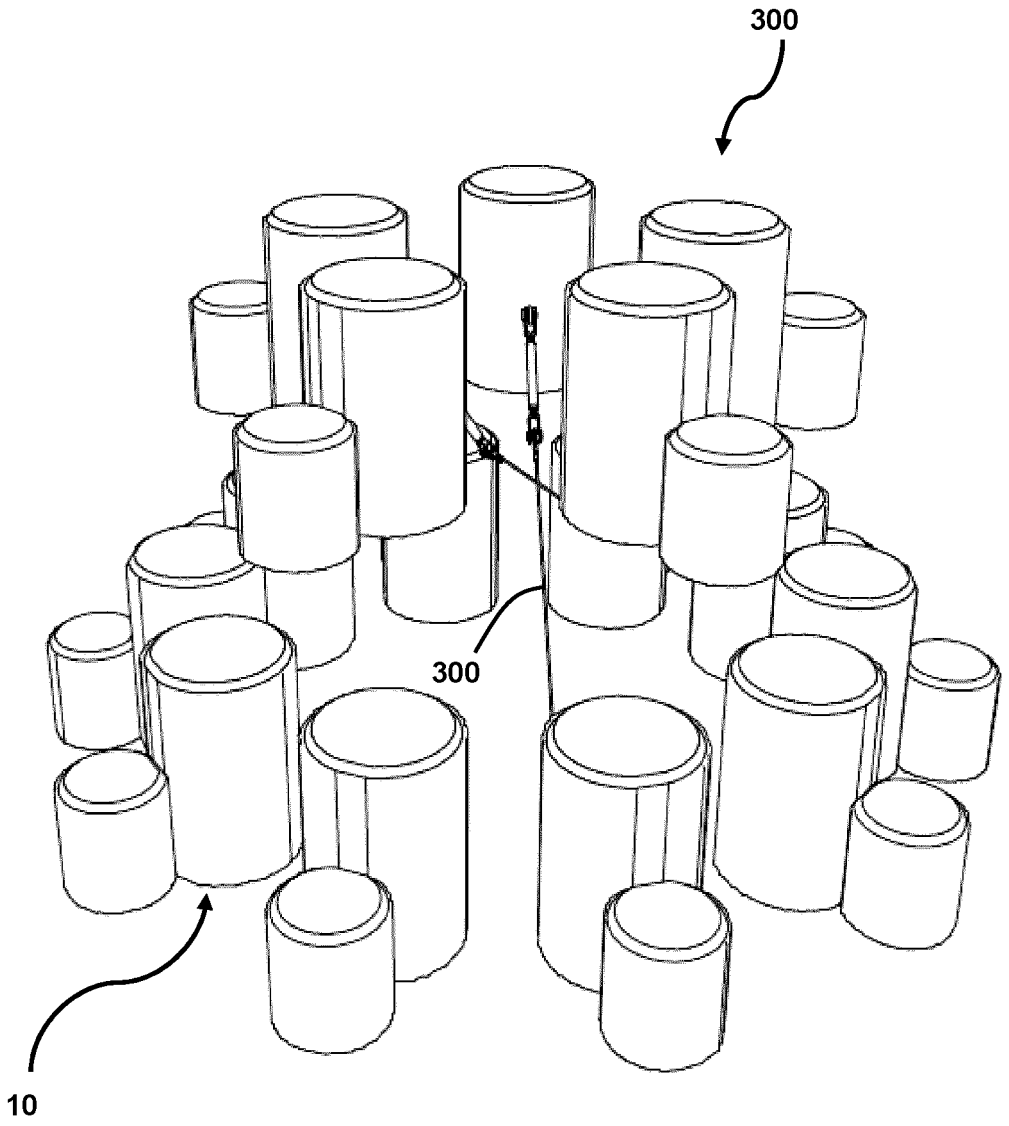
FIG. 13 is an exploded view of the components shown in FIG. 12.
Figure 14:
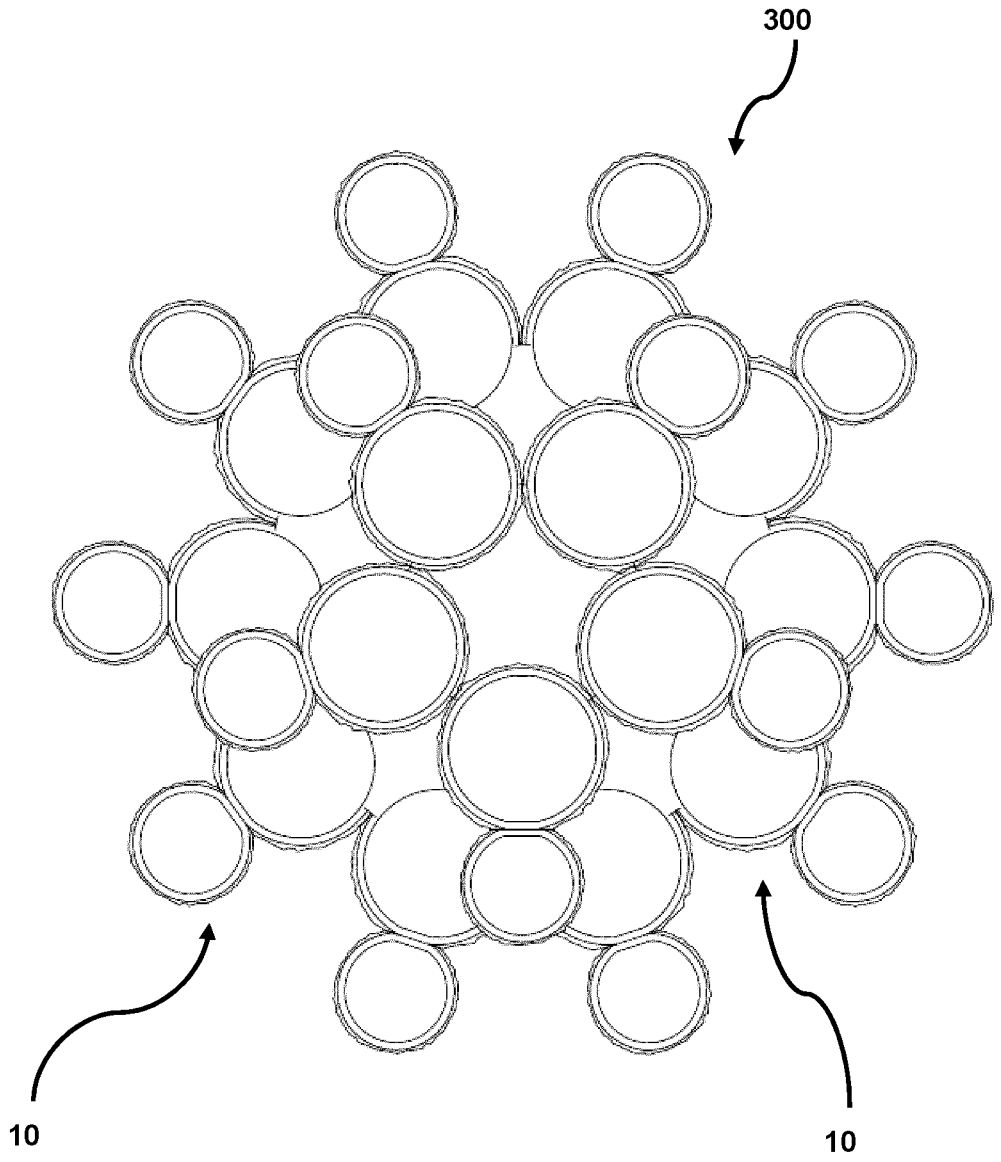
FIG. 14 is a top plan view of the arrangement of workstations shown in FIG. 12.

Referring to FIGS. 12 to 14, when not in use, the outdoor classrooms and early learning pods may be converted into safety compliant play and social gathering structures or tiered steading structures. FIG. 12 shows one such configuration where the workstations 10 are connected together and arranged into a climbing structure 300. FIG. 13 is a partially exploded view of the climbing structure 300 showing some of workstations 10 connected by cables 310 to provide greater stability. FIG. 14 is a top plan view of the climbing structure 300.

FIGS. 15 to 24 show several embodiments of the pre-school early learning pods as disclosed herein, which are designed to support early learners—infants to pre-school aged children—with a wider range of developmental needs and abilities than more mature school-aged children.

Early learning focuses on developing pre-writing skills through play based sensory engagement. As such pre-school early learning pods are not organized as a classroom system for students, but rather as an organized set of components that can be configured in different ways to optimize for intense, immersive sensory engagement and achieve certain core developmental outcomes for early childhood education. As such configurations are designed to enable sensory rich play based educational experiences for early learners.

All components are constructed of natural materials suitable for the local outdoor environment and designed for heavy, open-ended, unsupervised use for prolonged periods.

The pre-school early learning pods are designed using interlocking components so that any specific configuration is self-contained, self-stabilizing, safety compliant, and surface mountable without breaking the ground plane or requiring additional anchoring on virtually any surface including unlevel ground as well as concrete pads and rooftops. Vertical cluster logs and horizontal border logs are used to secure and support select feature components such as carved log tunnels, whacky logs, blackboards and carved wooden arm chairs or backed benches using interlocking dovetails to connect adjacent components, thus alleviating any need to break the ground plane or to anchor individual components.

Figure 15:
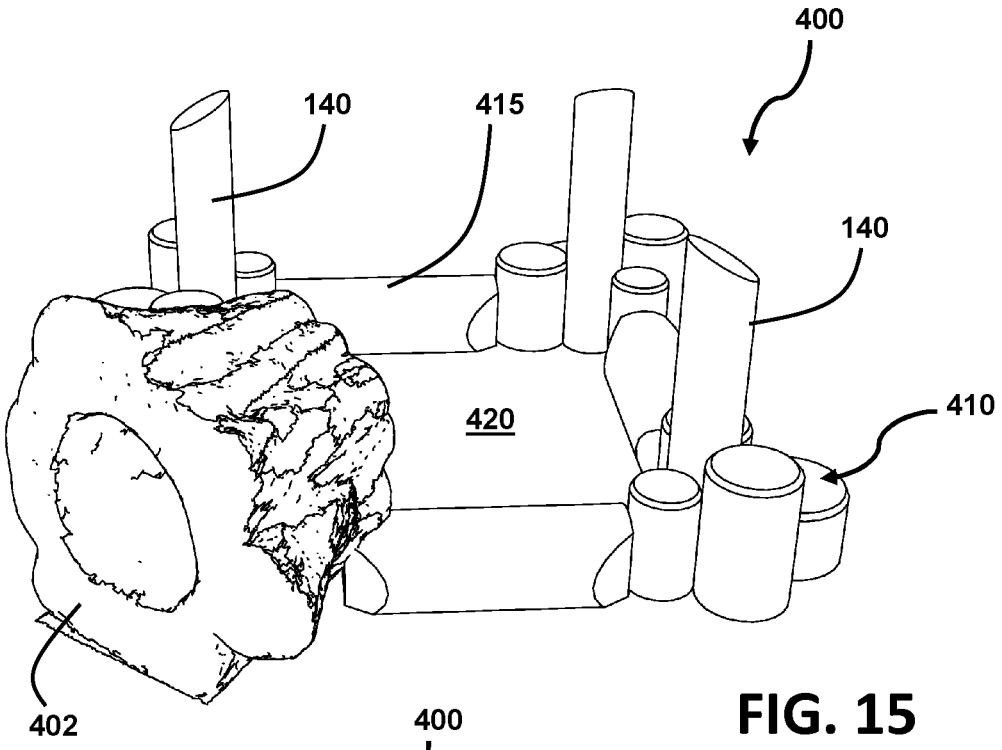
FIG. 15 is one embodiment of an early learning pod as disclosed herein.

FIG. 15 shows one configuration of an early learning pod 400 including a carved log tunnel 402, vertical cluster logs 410, horizontal border logs 415 and whacky support logs 140. The carved log tunnel 402 is constructed from the cross section of the trunk of a large mature tree that has been felled due to poor tree health or human safety concerns, and where the center cavity of the trunk has decayed and can be carved out, and where the ends have been milled flat and the sides have been minimally debarked to maintain the natural state and environmental defenses of the wood, as well as the sensory engagement of interacting with a real tree surface.

Vertical cluster logs 410 may be of various heights and diameters and configured to stand vertically together in clusters as shown in the figures. The vertical cluster logs 410 may be combined together in clusters with the whacky support logs 140. The horizontal border logs 415 may be arranged horizontally between clusters of vertical cluster logs 410 and whacky support logs 140 to form an enclosed area 420. Vertical cluster logs 410 are constructed of large caliper logs that may be fastened together using wood screws, where the bottom is uniform and milled flat and the tops are of varying height milled flat and beveled. The sides of the vertical cluster logs 410 have been minimally debarked to maintain the natural state and environmental defenses of the wood, as well as the sensory engagement of interacting with a real tree surface.

The side surfaces of the vertical cluster logs 410 that come into contact with adjacent early learning pod system components such as other vertical cluster logs 410, whacky support logs 140 or horizontal border logs 415 are notched for tongue and groove connection in a manner similar to that described and shown above for the seats 30 and desks 20 of the workstations 10.

Figure 23:
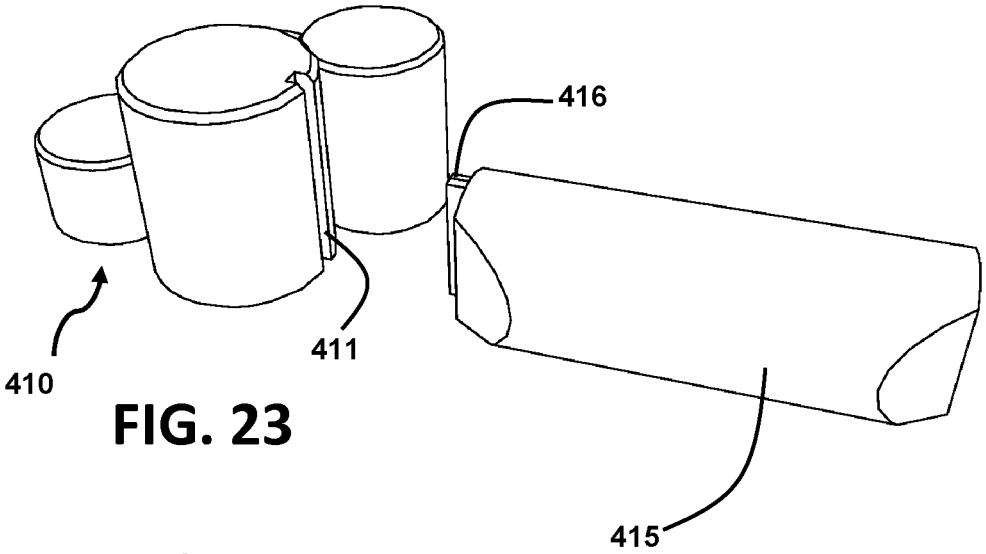
FIGS. 23 and 24 show the tongue and grove connection between a vertical log clusters and a horizontal border log.
Figure 24:
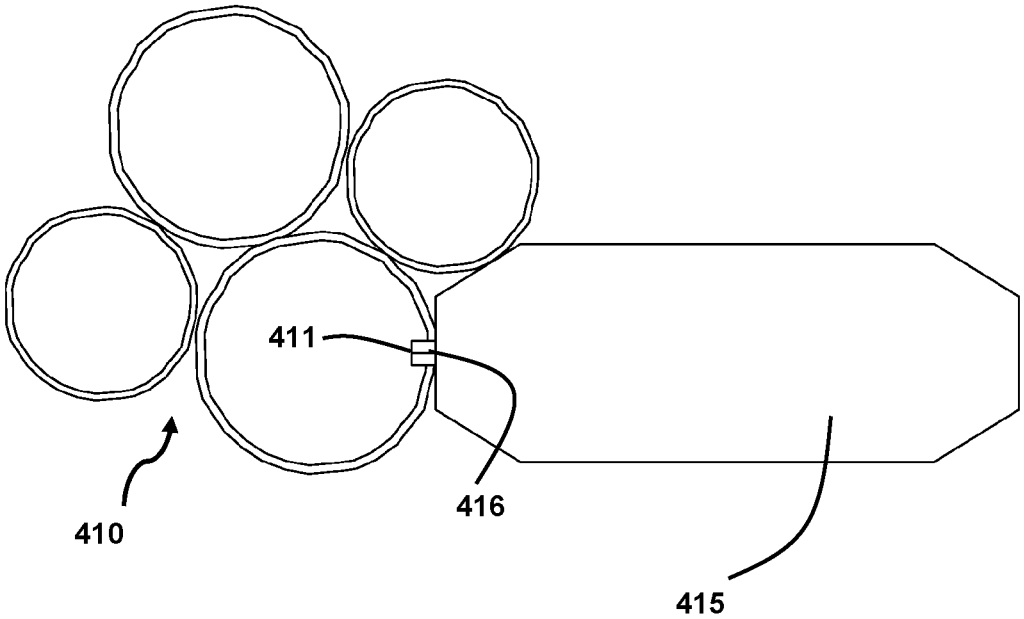

An example of the tongue and grove connection between the vertical cluster logs 410 and the horizontal border logs 415 is shown in FIGS. 23 and 24. A grove 411 is cut vertically into a side of one of the vertical cluster logs 410 and configured to engage with a tongue 416 formed on one end of the horizontal border log 415. The tongue 411 and the grove 416 may be formed in a dovetail shape to ensure a secure fit and prevent accidental disconnection. One skilled in the art will appreciate that the above-described tongue and groove system may in the alternative be configured with the groove formed into the horizontal border log 415 and the tongue formed into the desk 20.

Whacky support logs 140 are constructed of raw large caliper logs with minimal debarking to maintain the natural state and defenses of the wood, as well as the sensory engagement of interacting with a real tree surface.

Figure 16:
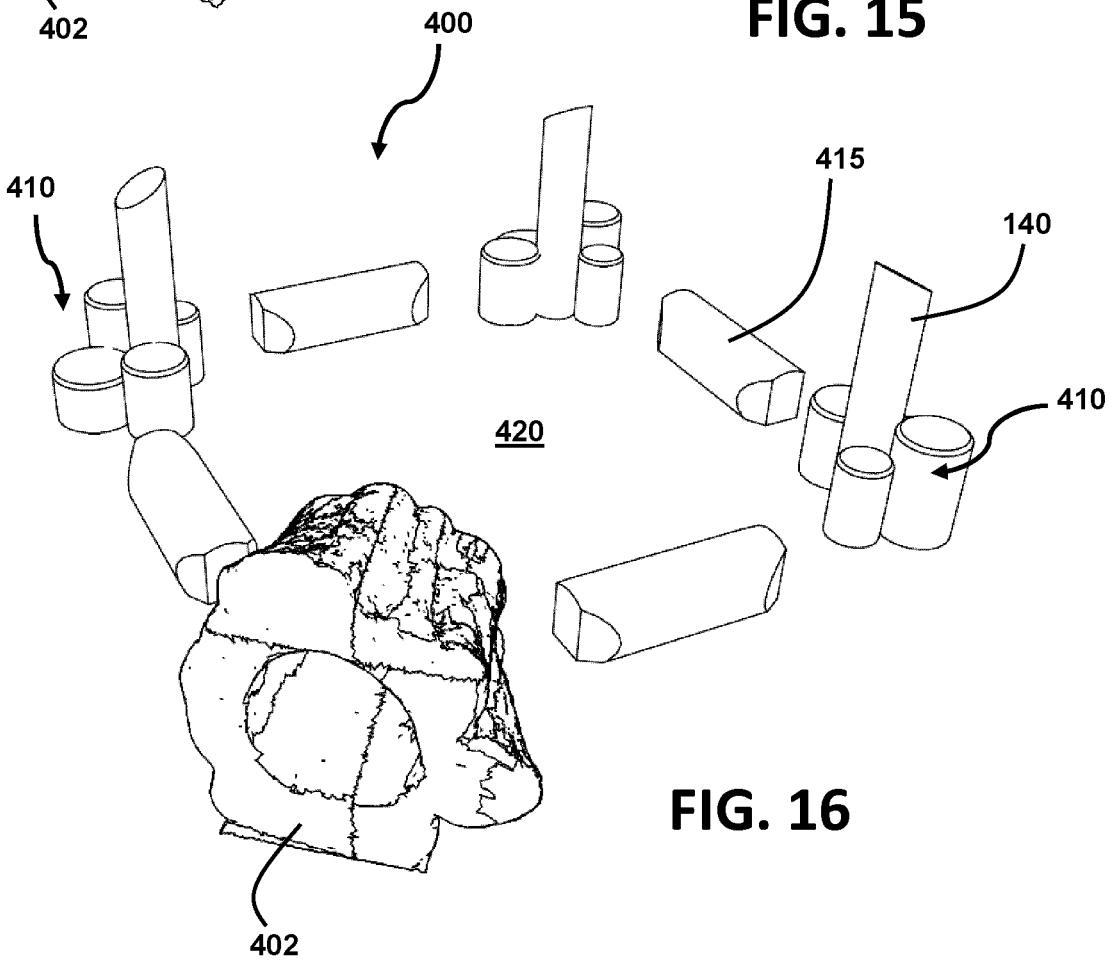
FIG. 16 is an exploded view of the embodiment shown in FIG. 15.

The log tunnel 402 may be used as an entrance to the enclosed area 420 or for any other purpose, including a source of play and entertainment for the students. FIG. 16 is an exploded view of the configuration shown in FIG. 15.

Figure 17:
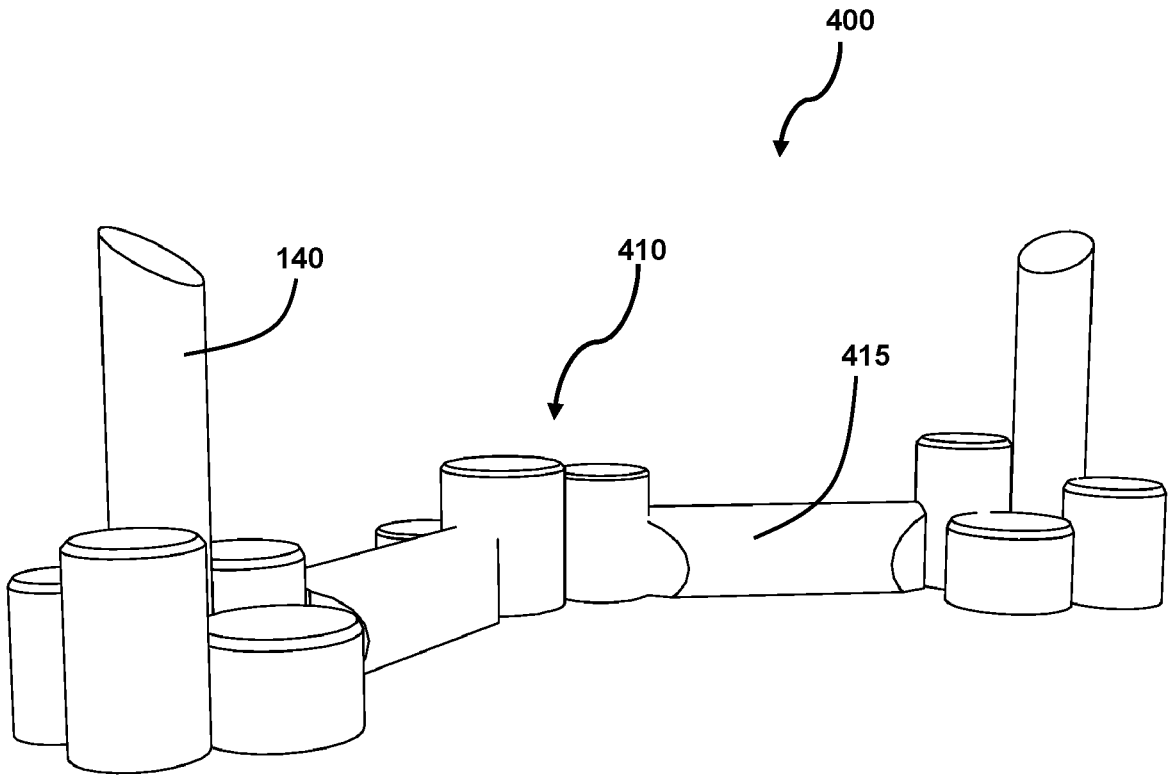
FIG. 17 is another embodiment of an early learning pod as disclosed herein.

FIG. 17 shows another arrangement of early learning pod 400, including vertical cluster logs 410, horizontal border logs 415, and whacky support logs 140 without creating the enclosed area 420.

Figure 18:
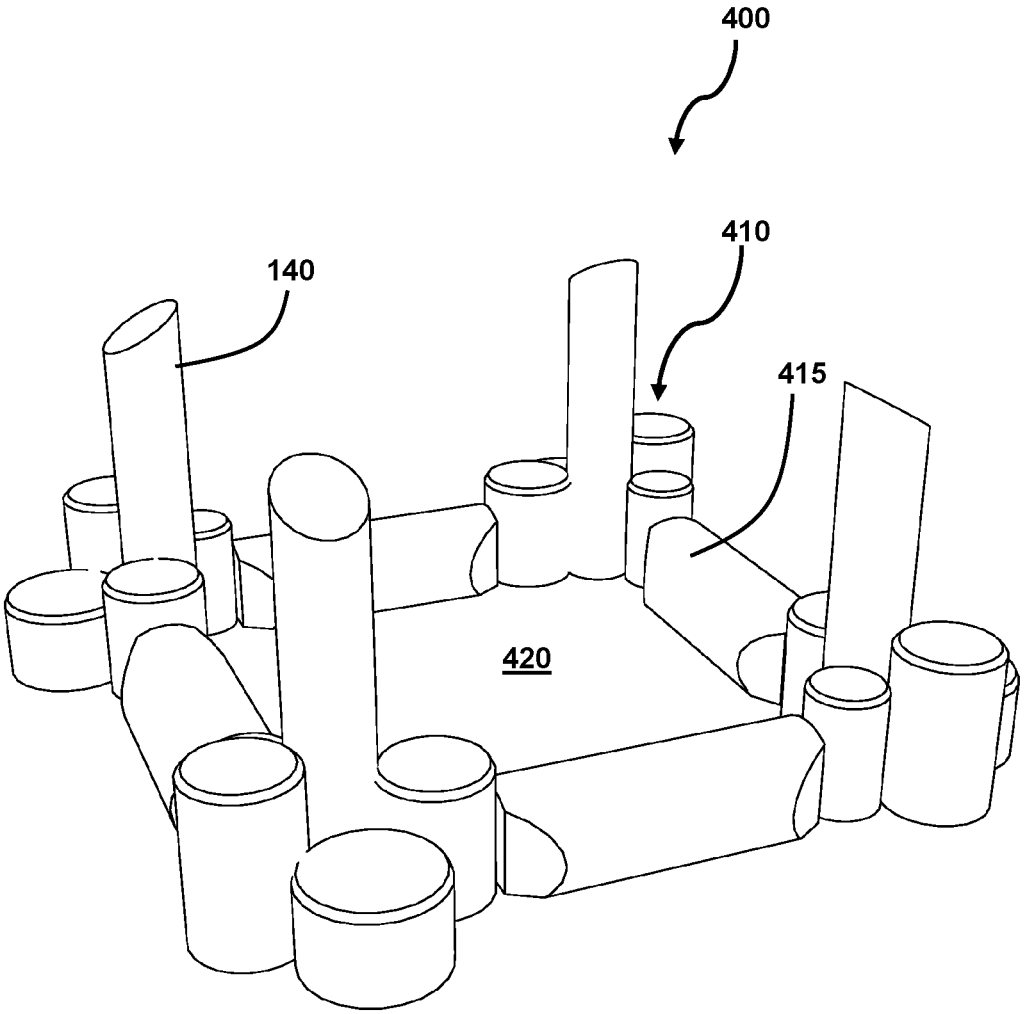
FIG. 18 is another embodiment of an early learning pod as disclosed herein.

FIG. 18 shows another arrangement of early learning pod 400, including vertical cluster logs 410, horizontal border logs 415 and whacky support logs 140 to form the enclosed area 420, but without the carved log tunnel log 400 shown in FIGS. 15 and 16.

Figure 19:
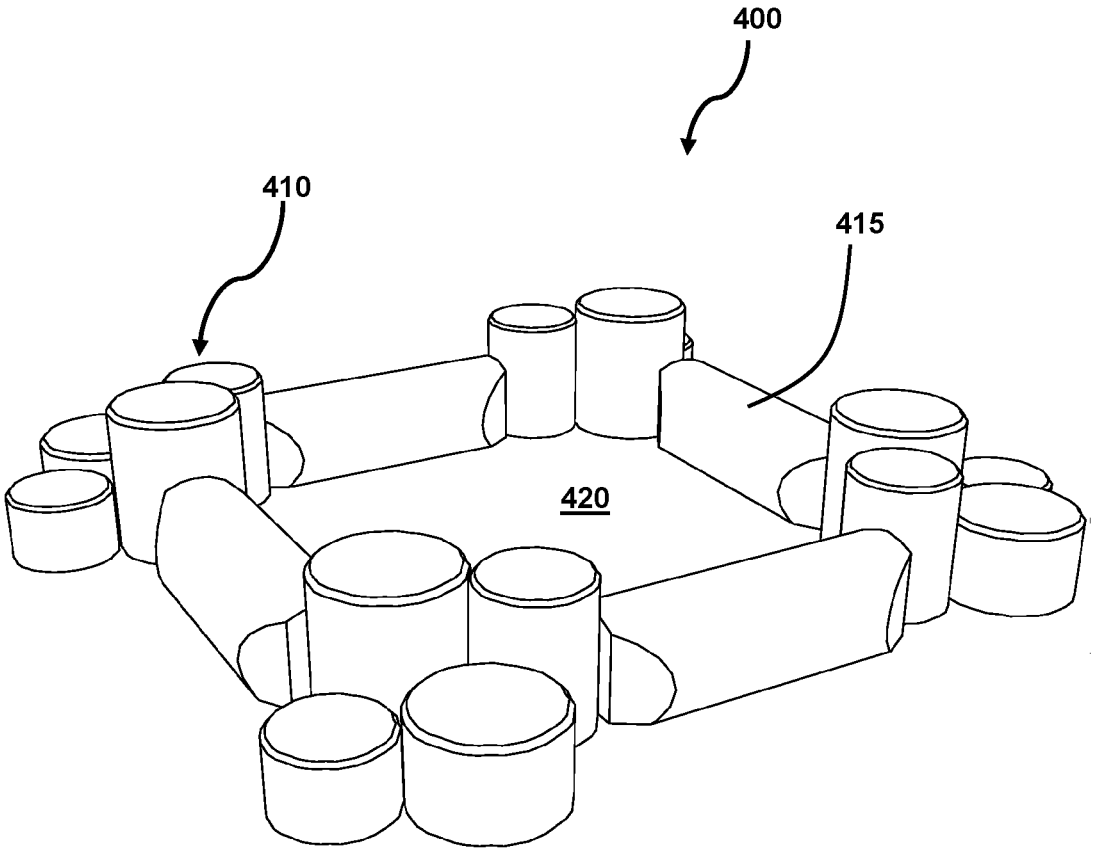
FIG. 19 is another embodiment of an early learning pod as disclosed herein.

FIG. 19 shows yet another arrangement of early learning pod 400, including vertical cluster logs 410 and horizontal border logs 415 to form the enclosed area 420, also without the carved log tunnel log 402 or the whacky support logs 140.

Figure 20:
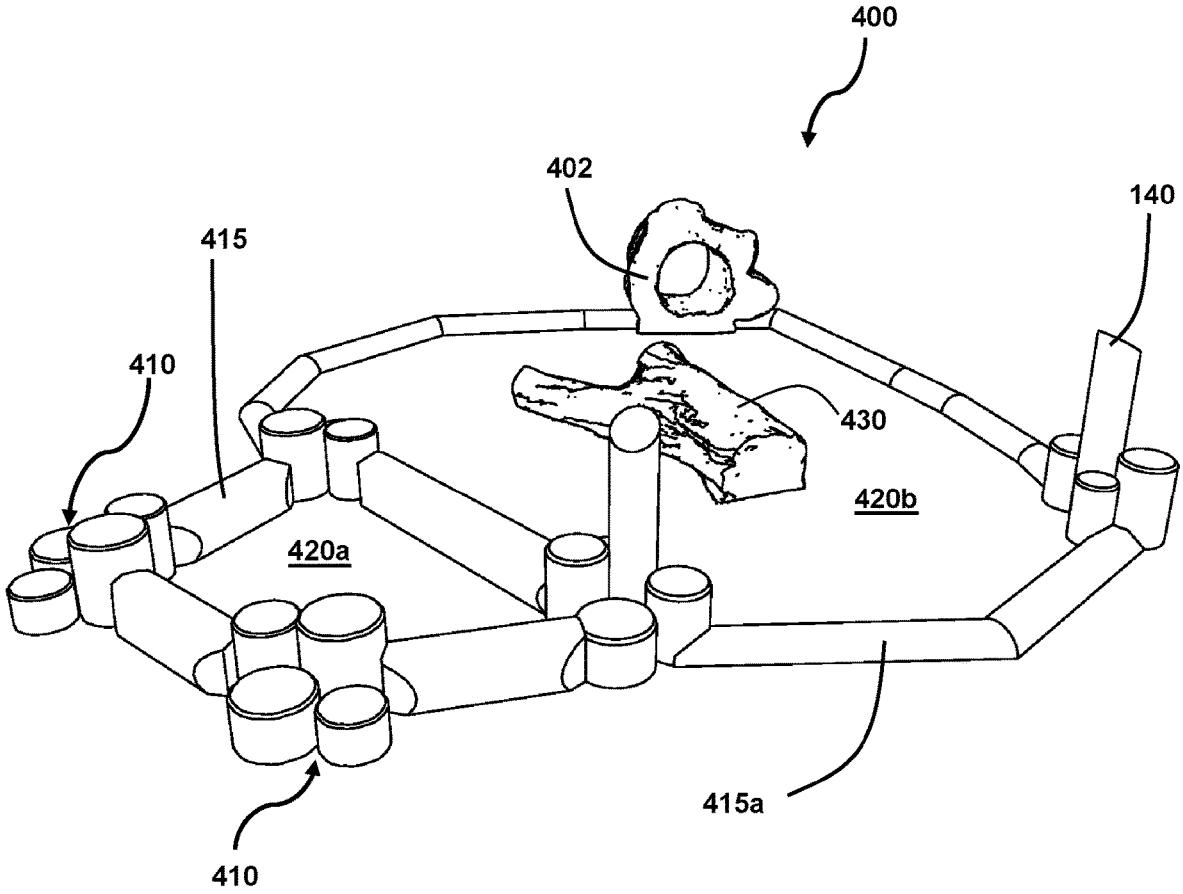
FIG. 20 is another embodiment of an early learning pod as disclosed herein.
Figure 21:
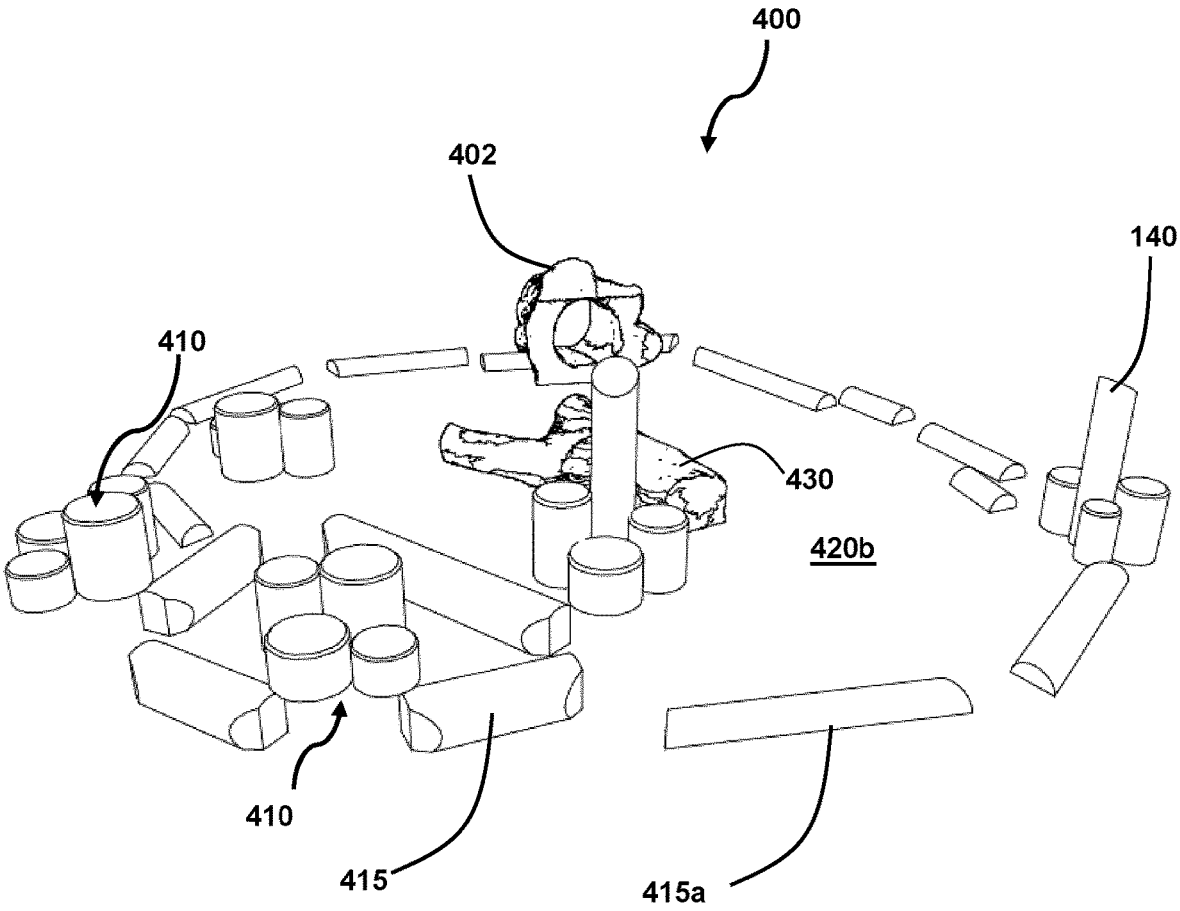
FIG. 21 is an exploded view of the embodiment of an early learning pod shown in FIG. 20.

FIG. 20 shows yet another arrangement of early learning pod 400, including vertical cluster longs 410 and horizontal border logs 415 and border half-logs 415*a*, in combination with carved log tunnel 402 and an amorphous log 430 to form two enclosed areas 420*a* and 420*b*. FIG. 21 is an exploded view of the configuration shown in FIG. 20. Horizontal border half logs 415*a* are similar to horizontal border logs 415 but have been split lengthwise in half.

Figure 22:
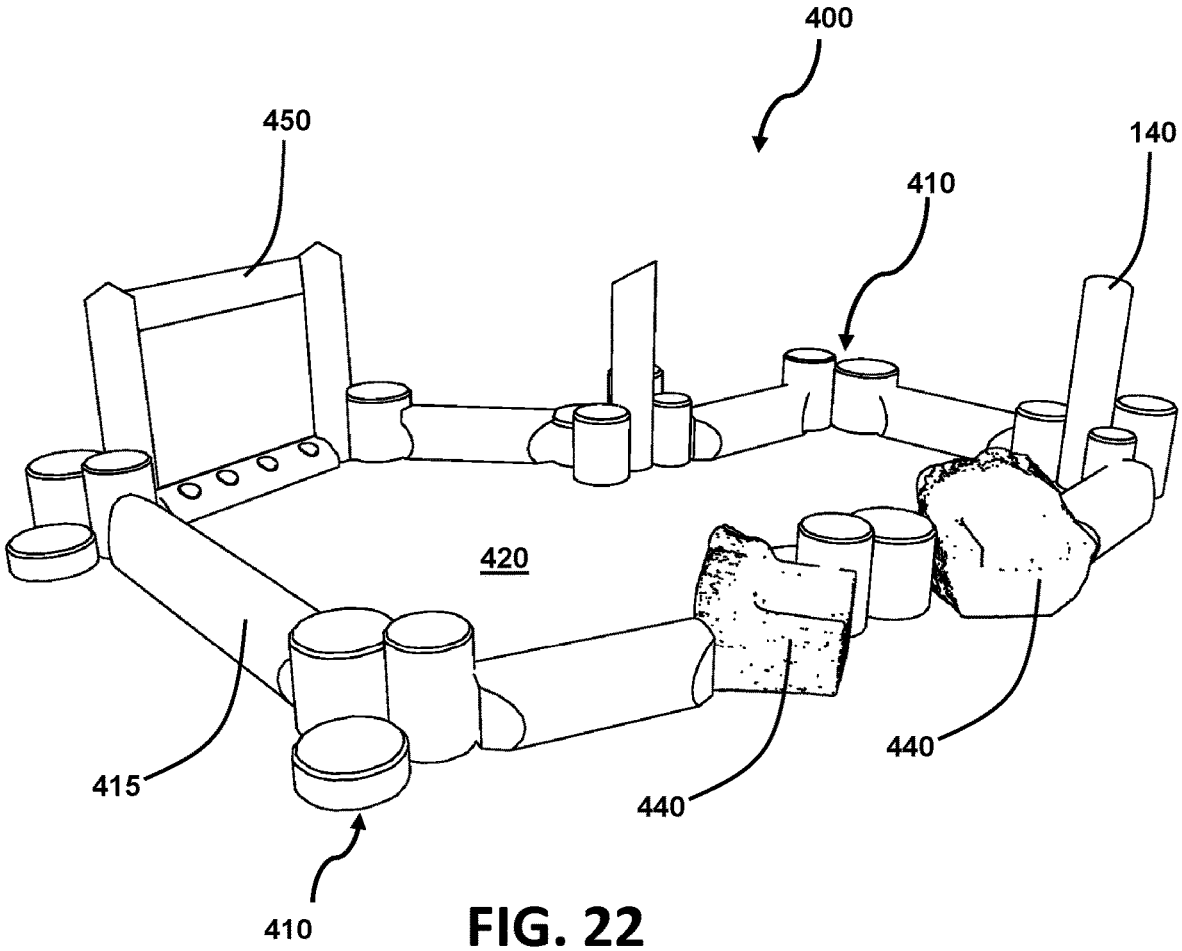
FIG. 22 is another embodiment of an early learning pod as disclosed herein.

FIG. 22 shows yet another configuration of early learning pod 400, including vertical cluster logs 410, horizontal border logs 415, chair logs 440, and a mirror 450, all arranged to form enclosed area 420. Carved chair logs 440 may be constructed in various sizes from red oak, red maple, Norway maple, silver maple or walnut, carved from a single log to form an accessible and ergonomic seating location for children of different ages and abilities, depending on the intended use for a given installation.

One skilled in the art will appreciate that other configurations and arrangements of the various components of the applicant's outdoor classroom system and early learning pods as disclosed herein are possible.

Components such as the desk 20, the seat 30, the whacky support logs 140, the vertical cluster logs 410 and horizontal border logs 415 and 415*a*, the carved log tunnel 4020, the amorphous log 430 and the chair log 440 may be constructed from sustainably sourced wood that can be obtained from a variety of tree species specifically suited to the local environments. Red oak and Douglas fir are common types of wood species that can be used for workstations 10 in the outdoor classroom system, as well as for vertical cluster logs 410 and horizontal boarder logs 415 in early learning pods systems 400. Cedar or Robina (black locust) are common types of wood species that can be used to construct the base and frame of blackboard 110 and curriculum cabinets 120, whacky support logs 140 as well as the fence panels and planters.

All components of the outdoor classroom system and early learning pods are built to withstand the local environment and inclement weather and to survive heavy, open-ended, unsupervised use for prolonged periods. The cylindrical design of workstations 10 in the outdoor classroom systems and vertical cluster logs 410 and horizontal boarder logs 415 and 415*a* in the early learning pods systems allows for components to be constructed of raw large caliper logs with minimal debarking to maintain the natural state and defenses of the wood. Blackboards 110 are designed for ground clearance in wild fields and constructed with a stabilizing base, rugged frame, and writing surface made from natural materials and coatings to withstand inclement weather conditions. Curriculum cabinets 120 are made to withstand extreme environmental conditions with a stabilizing base, rugged frame and doors with embedded blackboard writing surfaces for durability and functionality. Whacky support logs 140 are constructed of raw large caliper logs with minimal debarking to maintain the natural state and defenses of the wood. Shade sails 130 are made of natural materials and coatings to withstand and provide shade and shelter from inclement weather conditions over a long period. Fence panels and planters are constructed from chemical free, durable wood species.

The outdoor classroom system and pre-school early learning pods system disclosed herein provide a low-impact surface mount outdoor classroom system that allows each classroom to be set up or removed in an hour. Rather paying for dispose, when not being used the outdoor classroom and early learning pods disclosed herein may be reconfigured into safety compliant play or social gathering structures. The use of-natural materials and surfaces minimize or even negate heat island effects.

The embodiments described herein are intended to be illustrative of the present outdoor classroom system and pre-school early learning pods system and are not intended to limit the scope of the outdoor classroom system and pre-school early learning pods system. Various modifications and changes consistent with the description as a whole and which are readily apparent to the person of skill in the art are intended to be included. The appended claims should not be limited by the specific embodiments set forth in the examples but should be given the broadest interpretation consistent with the description as a whole.

The invention claimed is:

1. An early learning pod system that is self-stabilizing and mountable on a surface plane without breaking the surface plane and without requiring additional anchoring, the early learning pod system comprising:

a plurality of vertical cluster logs each vertical cluster log having a predetermined height, a predetermined diameter, a flat top and a flat bottom, wherein the vertical cluster logs are arranged into a plurality of clusters, each cluster including at least two of the vertical cluster logs, wherein the at least two vertical cluster logs in each of the clusters are fastened together such that the flat bottom of each of the at least two vertical cluster logs is on a same horizontal plane, thereby self-stabilizing the cluster without breaking the surface plane or requiring additional anchoring;

at least one horizontal border log removably connectable directly to at least one of the vertical cluster logs by a tongue and groove connection; and at least one vertical whacky support log having an angled top surface removably connectable directly to at least one of the vertical cluster logs by a tongue and groove connection.

2. The early learning pod system of claim 1, wherein the at least one horizontal border log is a plurality of horizontal border logs and wherein the clusters of vertical cluster logs and the horizontal border logs may be arranged to form at least one enclosed space when connected.

3. The early learning pod system of claim 2, further comprising a carved tunnel log forming an entrance to the enclosed space, wherein the carved tunnel log comprises a cross section of a trunk of a large mature tree comprising a cavity hollowed out along a longitudinal axis of the trunk, and wherein the entrance comprises the carved tunnel log installed such that the longitudinal axis of the trunk is parallel to the same horizontal plane and a first end of the cavity comprising a first end of the carved tunnel log is accessible from an exterior of the enclosure and a second end of the cavity comprising a second end of the carved tunnel log is accessible from an interior of the enclosure.

4. The early learning pod system according to claim 1 further comprising at least one horizontal half-log connectable directly to at least one of the vertical cluster logs by a tongue and groove connection.

5. The early learning pod system according to claim 1, further including an amorphous log.

6. The early learning pod system according to claim 1, further including at least one chair log.

7. The early learning pod system according to claim 1, further including at least one mirror.

8. The early learning pod system according to claim 1, wherein the predetermined height of a first one of the at least two vertical cluster logs in each cluster is different than that predetermined height of a second one of the at least two vertical cluster logs.

9. The early learning pod system according to claim 1, wherein the predetermined diameter of a first one of the at least two vertical cluster logs in each cluster is different than the predetermined diameter of a second one of the at least two vertical cluster logs.

* * * * *